US008535021B2

(12) United States Patent
Laessle et al.

(10) Patent No.: US 8,535,021 B2
(45) Date of Patent: Sep. 17, 2013

(54) PRECISION PUMP WITH MULTIPLE HEADS

(71) Applicant: Integrated Designs L.P., Carrollton, TX (US)

(72) Inventors: John Laessle, Plano, TX (US); John Vines, Dallas, TX (US); Brian Kidd, Frisco, TX (US)

(73) Assignee: Integrated Designs, L.P., Carrollton, TX (US)

( * ) Notice: Subject to any disclaimer, the term of this patent is extended or adjusted under 35 U.S.C. 154(b) by 0 days.

(21) Appl. No.: 13/670,083

(22) Filed: Nov. 6, 2012

(65) Prior Publication Data

US 2013/0129529 A1 May 23, 2013

Related U.S. Application Data

(63) Continuation of application No. 12/687,784, filed on Jan. 14, 2010, now Pat. No. 8,317,493, which is a continuation-in-part of application No. 11/938,408, filed on Nov. 12, 2007, now Pat. No. 8,047,815, which is a continuation-in-part of application No. 11/778,002, filed on Jul. 13, 2007, now abandoned.

(51) Int. Cl.
*F04B 43/067* (2006.01)
*B67D 7/58* (2010.01)

(52) U.S. Cl.
USPC ..... 417/395; 222/135

(58) Field of Classification Search
USPC ..... 417/26, 28, 46, 112, 121, 178, 179, 417/320, 360, 362, 395, 413.1, 440, 441; 222/334, 135, 137, 255
See application file for complete search history.

(56) References Cited

U.S. PATENT DOCUMENTS 2,419,993 A * 5/1947 Green et al. ..... 417/344
2,427,818 A * 9/1947 Taylor ..... 417/199.1

(Continued)

FOREIGN PATENT DOCUMENTS

EP 0844424 5/1998
EP 1602830 A1 * 12/2005
GB 2156445 10/1985

OTHER PUBLICATIONS

Sematech, Technology Transfer Department, "Guide to High Purity Deionized Water and Chemical Distribution Systems in Semiconductor Manufacturing Equipment", 1995, 1998, J., SEMI-49.2.0298, American Society for Testing and Materials.

*Primary Examiner* — Devon Kramer
*Assistant Examiner* — Nathan Zollinger
(74) *Attorney, Agent, or Firm* — Caesar, Rivise, Bernstein, Cohen & Pokotilow, Ltd.

(57) ABSTRACT

A pump for one or more different process fluids is provided including a pumping chamber having a process fluid inlet and outlet coupled to a process fluid valve on each pumping chamber for selectively preventing and allowing flow of process fluid through the pumping chamber. An actuation mechanism for pumping actuating fluid to actuating fluid chambers is provided that is in communication with the actuating fluid chambers to permit flow into each actuating fluid chamber of incompressible actuating fluid. A diaphragm separates each pumping chamber from an associated actuating fluid chamber for separating process fluid from actuating fluid. The actuation mechanism is removable by a quick disconnect that provides for disconnection of the activation mechanism without affecting process fluid. Operation of the actuation mechanism to displace actuating fluid causes actuating fluid to flow only into each actuating fluid chamber having an opened process fluid valve, resulting in pumping.

25 Claims, 23 Drawing Sheets

(56) References Cited

U.S. PATENT DOCUMENTS

| | | | | | |
|---|---|---|---|---|---|
| 2,653,552 | A | * | 9/1953 | Geeraert | 417/317 |
| 2,673,525 | A | * | 3/1954 | Lucas | 417/203 |
| 2,881,709 | A | * | 4/1959 | Williams | 417/63 |
| 3,036,433 | A | * | 5/1962 | Loup | 60/471 |
| 3,207,080 | A | * | 9/1965 | Schlosser | 417/390 |
| 3,749,526 | A | * | 7/1973 | Ferrentino | 417/390 |
| 4,543,044 | A | * | 9/1985 | Simmons | 417/342 |
| 4,548,551 | A | * | 10/1985 | Ruttenberg et al. | 417/393 |
| 4,634,430 | A | * | 1/1987 | Polaschegg | 604/141 |
| 4,844,706 | A | * | 7/1989 | Katsuyama et al. | 417/339 |
| 4,915,599 | A | * | 4/1990 | Katsuyama et al. | 417/393 |
| 4,950,134 | A | * | 8/1990 | Bailey et al. | 417/383 |
| 5,061,156 | A | * | 10/1991 | Kuehne et al. | 417/412 |
| 5,165,869 | A | | 11/1992 | Reynolds | |
| 5,262,068 | A | * | 11/1993 | Bowers et al. | 210/767 |
| 5,269,811 | A | * | 12/1993 | Hayes et al. | 623/3.24 |
| 5,332,372 | A | * | 7/1994 | Reynolds | 417/393 |
| 5,616,005 | A | * | 4/1997 | Whitehead | 417/46 |
| 5,762,795 | A | * | 6/1998 | Bailey et al. | 210/416.1 |
| 5,803,122 | A | | 9/1998 | Theilmeier | |
| 5,957,153 | A | * | 9/1999 | Frey et al. | 137/240 |
| 5,961,300 | A | * | 10/1999 | Pitzer et al. | 417/395 |
| 6,162,030 | A | | 12/2000 | Pierrat | |
| 6,241,487 | B1 | * | 6/2001 | Reynolds | 417/395 |
| 6,250,502 | B1 | * | 6/2001 | Cote et al. | 222/1 |
| 6,325,932 | B1 | * | 12/2001 | Gibson | 210/416.1 |
| 6,348,124 | B1 | * | 2/2002 | Garbett et al. | 156/345.12 |
| 6,391,111 | B1 | | 5/2002 | Fujimoto et al. | |
| 6,419,841 | B1 | | 7/2002 | Snodgrass et al. | |
| 6,511,306 | B2 | | 1/2003 | Pierrat | |
| 6,644,930 | B1 | * | 11/2003 | Kuismanen | 417/53 |
| 6,742,993 | B2 | | 6/2004 | Savard et al. | |
| 6,767,877 | B2 | * | 7/2004 | Kuo et al. | 510/175 |
| 6,797,063 | B2 | | 9/2004 | Mekias | |
| 7,225,946 | B2 | * | 6/2007 | Gardos | 222/1 |
| 7,476,087 | B2 | * | 1/2009 | Zagars et al. | 417/44.2 |
| 7,669,737 | B2 | * | 3/2010 | Bethuy et al. | 222/129.1 |
| 8,047,815 | B2 | | 11/2011 | Savard et al. | |
| 8,317,493 | B2 | * | 11/2012 | Laessle et al. | 417/395 |
| 2002/0043502 | A1 | * | 4/2002 | Snodgrass et al. | 210/739 |
| 2003/0062382 | A1 | * | 4/2003 | Savard et al. | 222/52 |
| 2007/0104586 | A1 | * | 5/2007 | Cedrone et al. | 417/26 |
| 2008/0142102 | A1 | | 6/2008 | Savard | |
| 2008/0226466 | A1 | * | 9/2008 | Eysymontt | 417/53 |
| 2009/0016903 | A1 | | 1/2009 | Savard et al. | |
| 2009/0016909 | A1 | | 1/2009 | Savard et al. | |

* cited by examiner

PRECISION PUMP WITH MULTIPLE HEADS

CROSS-REFERENCE TO RELATED APPLICATIONS

This application is a continuation application of U.S. application Ser. No. 12/687,784, filed on Jan. 14, 2010, entitled Precision Pump with Multiple Heads, which is a continuation-in-part application of U.S. application Ser. No. 11/938,408, now U.S. Pat. No. 8,047,815, filed on Nov. 12, 2007, entitled Precision Pump with Multiple Heads, which is a continuation-in-part application of U.S. application Ser. No. 11/778,002, filed on Jul. 13, 2007, entitled Precision Pump with Multiple Heads, abandoned.

FIELD OF THE INVENTION

The present invention relates generally to apparatus used in metering fluids with high precision, particularly in fields such as semiconductor manufacturing.

BACKGROUND OF THE INVENTION

Many of the chemicals used in manufacturing integrated circuits, photomasks, and other devices with very small structures are corrosive, toxic and expensive. One example is photoresist, which is used in photolithographic processes. In such applications, both the rate and amount of a chemical in liquid phase—also referred to as process fluid or "chemistry"—that is dispensed onto a substrate must be very accurately controlled to ensure uniform application of the chemical and to avoid waste and unnecessary consumption. Furthermore, purity of the process fluid is often critical. Even the smallest foreign particles contaminating a process fluid cause defects in the very small structures formed during such processes. The process fluid must, therefore, be handled by a dispensing system in a manner that avoids contamination. See, for example, Semiconductor Equipment and Material International, "SEMI E49.2-0298 Guide for High Purity Deionized Water and Chemical Distribution Systems in Semiconductor Manufacturing Equipment" (1998). Improper handling can also result in introduction of gas bubbles and damage the chemistry. For these reasons, specialized systems are required for storing and metering fluids in photolithography and other processes used in fabrication of devices with very small structures.

Chemical distribution systems for these types of applications therefore must employ a mechanism for pumping process fluid in a way that permits finely controlled metering of the fluid and avoids contaminating and/or reacting with the process fluid. Generally, a pump pressurizes process fluid in a line to a dispense point. The fluid is drawn from a source that stores the fluid, such as a bottle or other container. The dispense point can be a small nozzle or other opening. The line from the pump to a dispense point on a manufacturing line is opened and closed with a valve. The valve can be placed at the dispense point. Opening the valve allows process fluid to flow at the point of dispense. A programmable controller operates the pumps and valves. All surfaces within the pumping mechanism, lines and valves that touch the process fluid must not react with or contaminate the process fluid. The pumps, containers of process fluid, and associated valving are sometimes stored in a cabinet that also house a controller.

Pumps for these types of systems are typically some form of a positive displacement type of pump, in which the size of a pumping chamber is enlarged to draw in fluid into the chamber, and then reduced to push it out. Types of positive displacement pumps that have been used include hydraulically actuated diaphragm pumps, bellows type pumps, piston actuated, rolling diaphragm pumps, and pressurized reservoir type pumping systems. U.S. Pat. No. 4,950,134 (Bailey et al.) is an example of a typical pump. It has an inlet, an outlet, a stepper motor and a fluid displacement diaphragm. When the pump is commanded electrically to dispense, the outlet valve opens and the motor turns to force flow of a displacement or actuating fluid into the actuating fluid chamber, resulting in the diaphragm moving to reduce the size the pumping chamber. Movement of the diaphragm forces process fluid out the pumping chamber and through the outlet valve.

Due to concerns over contamination, current practice in the semiconductor manufacturing industry is to use a pump only for pumping a single type of processing fluid or "chemistry." In order to change chemistries being pumped, all of the surfaces contacting the processing fluid have to be changed. Depending on the design of the pump, this tends to be cumbersome and expensive, or simply not feasible. It is not uncommon to see processing systems that use up to 50 pumps in today's fabrication facilities.

A dispensing apparatus that supplies process chemicals from different sources is shown in U.S. Pat. No. 6,797,063 (Mekias). Here, the dispensing apparatus has two or more process chambers inside of a control chamber. The volume of the process chambers increases or decreases by adding control fluid to or removing control fluid from the control chamber. The use of valving at the inlets and outlets of the process chambers, in combination with a pressurized fluid reservoir that controls fluid into and out of the control chamber controls the flow of dispensed fluid through the process chambers.

One highly desirable feature of a precision pump not heretofore know is the ability to separate and remove components of the pump for maintenance or repair without breaking into the process fluid flow lines that are attached to one or more pump chamber heads. This would include avoiding opening of any seals in the process fluid flowpath either into, through, or out of the pump.

BRIEF SUMMARY OF THE INVENTION

The invention pertains generally to high precision pumps for use in dispensing process fluids in applications imposing constraints on handling due to corrosiveness of the process fluid, and/or due to sensitivity to contamination (e.g., from other fluids, particulates, etc.), bubbles and/or mechanical stresses. It is particularly useful for pumps in semiconductor processing operations.

In contradiction to typical deployments of pumps in such applications, particularly those used for high-precision metering, an exemplary pump employing teachings of a preferred embodiment of the invention is capable of pumping more than one type of chemistry or process fluid without requiring cleaning or changing of surfaces contacting the processing fluid. The pump employs multiple pumping heads, each capable of handling a different type of manufacturing fluid. Multiple pumping heads share a common actuation mechanism. Although each pump might be larger when compared to a pump with a single head, utilizing fewer actuation mechanisms than pumping heads saves very valuable space in crowded processing facilities, such as those used for fabricating semiconductor components, which use a large number of pumps. Since actuation mechanisms are sometimes the most complex part of a pump, fewer actuation mechanism in a factory saves money and maintenance time.

Sharing a single actuation mechanism among multiple heads may seem undesirable, particularly for fluid metering applications. Having a shared actuation mechanism typically means that only one pumping head may be actuated at a time. However, in one embodiment the exemplary pump is capable of fast and frequent switching between pump heads. With actuation between pump heads capable of being switched quickly, there is little delay between demand for dispense and dispense in applications having very short dispense cycles due to relatively small amounts of fluid that are being dispensed.

In accordance with a first preferred embodiment of the present invention, a pump for use in handling one or more different process fluids is provided which includes a plurality of pumping chambers, where each pumping chamber includes at least one process fluid inlet and at least one process fluid outlet. The process fluid outlet on each pumping chamber is coupled to at least one process fluid valve on each pumping chamber for selectively preventing and allowing the flow of process fluid through the pumping chamber. An actuation mechanism for pumping actuating fluid to a plurality of actuating fluid chambers is provided that is in fluid communication with the plurality of actuating fluid chambers to permit flow into each actuating fluid chamber of substantially incompressible actuating fluid. At least one diaphragm is provided that separates each pumping chamber from an associated actuating fluid chamber, for separating process fluid from actuating fluid. Operation of the actuation mechanism to displace actuating fluid causes actuating fluid to flow only into each of the plurality of actuating fluid chambers having an opened process fluid valve, resulting in pumping.

Unrestricted flow of actuating fluid from the actuating fluid chamber into the actuation mechanism is preferably provided. The actuation mechanism may be a piston translated by a screw turned by a stepper motor. A controller may be provided for selectively operating the at least one process fluid valve to which each of the plurality of pumping chambers is coupled to selectively allow and stop flow of process fluid. The at least one process fluid valve may include a controllable valve for selectively opening and closing a line coupled with the process fluid outlet. Here, a one-way check valve coupled with the process fluid outlet of each of the plurality of pumping chambers may be provided for allowing fluid to flow only in one direction out of the pumping chamber, and a one-way check valve coupled with the process fluid inlet of each of the plurality of pumping chambers may be provided for allowing fluid to flow only in one direction into the pumping chamber. Each of the plurality of pumping chambers may be coupled with a process fluid nozzle for dispensing process fluid. The process fluid nozzles coupled to a plurality of pumping chambers may be located and arranged on a processing line for dispensing process fluids onto a semiconductor wafer. The process fluid outlet of each of the plurality of pumping chambers may be in fluid communication with a filter for filtering the process fluid. The actuation mechanism may be mounted within a body, and each of the plurality of pumping chambers may be at least partially formed by a removable pump head structure supported on the body. A plurality of pump head structures may be arrayed around the body. A flow path between the process fluid inlet and the process fluid outlet on each pumping chamber may be substantially uphill to facilitate bubble removal.

In accordance with another preferred embodiment of the present invention, a pump for use in handling one or more different process fluids is provided. The pump includes an actuation mechanism for pumping actuating fluid, a plurality of pumping chambers and a like plurality of actuating fluid chambers, forming a plurality of pairs of pumping chambers and actuating fluid chambers, each pair having one of said pumping chambers adjacent one of said actuating fluid chambers, and each pumping chamber including at least one process fluid inlet and at least one process fluid outlet. A diaphragm associated with each pair is provided, located between the pumping chamber and actuating fluid chamber, for separating process fluid from actuating fluid. Each actuating fluid chamber is in fluid communication with the actuation mechanism permitting flow into the actuating fluid chamber of substantially incompressible actuating fluid. The process fluid outlet on each pumping chamber is coupled to at least one process fluid valve associated with each pumping chamber for selectively preventing and allowing the flow of process fluid through the pumping chamber. Operation of the actuation mechanism to displace actuating fluid causes actuating fluid to flow only into each of the plurality of actuating fluid chambers having an opened process fluid valve, resulting in pumping.

Unrestricted flow of actuating fluid from the actuating fluid chamber into the actuation mechanism may be provided. The actuation mechanism may be comprised of a piston translated by a screw turned by a stepper motor. The pump may further include a controller for selectively operating the at least one process fluid valve to which each of the plurality of pumping chambers is coupled to selectively allow and stop flow of process fluid.

At least one process fluid valve may include a controllable valve for selectively opening and closing a line coupled with the process fluid outlet. Here, a one-way check valve coupled with the process fluid outlet of each of the plurality of pumping chambers may be provided for allowing fluid to flow only in one direction out of the pumping chamber, and a one-way check valve coupled with the process fluid inlet of each of the plurality of pumping chambers may be provided for allowing fluid to flow only in one direction into the pumping chamber. Each of the plurality of pumping chambers may be coupled with a process fluid nozzle for dispensing process fluid. Here, the process fluid nozzles coupled to a plurality of pumping chambers may be located and arranged on a processing line for dispensing process fluids onto a semiconductor wafer.

The process fluid outlet of each of the plurality of pumping chambers may be in fluid communication with a filter for filtering the process fluid. The actuation mechanism may be mounted within a body, and each of the plurality of pumping chambers may be at least partially formed by a removable pump head structure supported on the body. A plurality of pump head structures may be arrayed around the body.

In another embodiment of the present invention, a pump for use in concurrently handling one or more different process fluids is provided which includes a central reservoir for storing substantially incompressible actuating fluid, in which a displacement member is disposed for moving actuating fluid into and out of the reservoir, a plurality of pumping chambers surrounding the central reservoir, each pumping chamber including at least one process fluid inlet and at least one process fluid outlet, and a plurality of actuating chambers for receiving actuating fluid from the reservoir. Each of the plurality of pumping chambers includes a diaphragm, the diaphragm separating each pumping chamber from an adjacent one of the actuating chambers and separating actuating fluid in the actuating chambers from process fluid in the pumping chambers. At least one channel permits flow between the actuating chamber and the reservoir of substantially incompressible actuating fluid. At least one valve coupled with the at least one process fluid outlet is coupled for preventing and allowing the flow of process fluid through the pumping chamber. Operation of the actuation mechanism to displace actuating fluid causes fluid to flow only into pumping chambers with outlets coupled with at least one valve that is opened.

For each pumping chamber, a one-way check valve coupled with the process fluid outlet may be provided for allowing fluid to flow only in one direction out of the pumping chamber, and a one-way check valve coupled with the process fluid inlet of each of the pumping chambers may be provided for allowing fluid to flow only in one direction into the pumping chamber.

The pump may have a body having formed thereon a plurality of faces where each face has mounted thereon one of the pump head structures. Each face cooperates with one of a plurality of the removable pump head structures. The adjacent actuating fluid chambers may be located on the body. The diaphragm for each pumping chamber may be mounted between respective ones of the plurality of pump head structures and the actuating fluid chambers of the body.

In another alternate embodiment of the present invention, a pump for use in handling one or more different process fluids is provided which includes an actuation mechanism for pumping actuating fluid, a plurality of pumping chambers and a like plurality of actuating fluid chambers, forming a plurality of pairs, each pair having one of the pumping chambers adjacent one of the actuating fluid chambers, and each pumping chamber including at least one process fluid inlet and at least one process fluid outlet. A diaphragm associated with each pair is provided, located between the pumping chamber and actuating fluid chamber, for separating process fluid from actuating fluid. Each actuating fluid chamber is in fluid communication with the actuation mechanism to provide for flow into each actuating fluid chamber of substantially incompressible actuating fluid. The process fluid inlet on a first one of the pumping chambers is in communication with a source of process fluid, the process fluid outlet on the first one of the pumping chambers in communication with the process fluid inlet on a second one of the pumping chambers, and the process fluid outlet on the second one of the pumping chambers is in fluid communication with a dispense point. Each pumping chamber is coupled to at least one process fluid valve on each pumping chamber for selectively preventing and allowing the flow of process fluid through the pumping chamber. Operation of the actuation mechanism to displace actuating fluid causes actuating fluid to flow only into each of the plurality of actuating fluid chambers having an opened process fluid valve, resulting in pumping.

The process fluid outlet on the first one of the pumping chambers may be in communication with an inlet of a fluid treatment unit for treating process fluid, the process fluid inlet on a second one of the pumping chambers may be in communication with an outlet of the fluid treatment unit, and the process fluid outlet on the second one of the pumping chamber may be in fluid communication with a dispense point. The fluid treatment unit may be a filter.

A valve between the actuating mechanism and the actuating fluid chamber in the first one of the pumping chambers and a valve between the actuating mechanism and an inlet of the actuating fluid chamber in the second one of pumping chambers may be provided. A valve between an outlet of the actuating fluid chamber in the first one of the pumping chambers and the fluid treatment unit may be provided. The actuation mechanism may be comprised of a piston translated by a screw turned by a stepper motor. A controller for selectively operating the at least one process fluid valve to which each of the plurality of pumping chambers is coupled to selectively allow and stop flow of process fluids may be provided. The at least one process fluid valve may include a controllable valve for selectively opening and closing a line coupled with the process fluid outlet. A one-way check valve coupled with the process fluid outlet of each of the plurality of pumping chambers may be provided for allowing fluid to flow only in one direction out of the pumping chamber, and a one-way check valve coupled with the process fluid inlet of each of the plurality of pumping chambers may be provided for allowing fluid to flow only in one direction into the pumping chamber. Each of the plurality of pumping chambers may be coupled with a process fluid nozzle for dispensing process fluid. The process fluid nozzles coupled to a plurality of pumping chambers may be located and arranged on a processing line for dispensing process fluids onto a semiconductor wafer. The process fluid outlet of each of the plurality of pumping chambers may be in fluid communication with a filter for filtering the process fluid. The process fluid inlet on a third one of the pumping chambers may be in communication with a second source of process fluid, the process fluid outlet on the third one of the pumping chambers may be in communication with the process fluid inlet on a fourth one of the pumping chambers, and the process fluid outlet on the fourth one of the pumping chambers may be in fluid communication with a dispense point. The actuation mechanism may be mounted within a body, and each of the plurality of pumping chambers may be at least partially formed on the body. A plurality of pump head structures may be provided that are arrayed around the body. The actuation mechanism may be reversible and process fluid valve may be configurable to achieve internal suck back. An external suck back valve may be located adjacent to the dispense point.

In another embodiment of the present invention, for a pump which includes an actuation mechanism for pumping actuating fluid, a plurality of pumping chambers, and a plurality of actuating chambers where each actuating chamber in fluid communication with the actuation mechanism through at least one fluid communication channel permitting flow of actuating fluid between the actuating chamber and actuating mechanism, each of the plurality of pumping chambers including at least one process fluid inlet and one process fluid outlet, a method is provided. The method includes the steps of charging each of the plurality of pumping chambers with process fluid, activating the actuation mechanism in a first direction and operating valves to cause a first of the plurality of pumping chambers to fill with process fluid from a source, activating the actuation mechanism in a second direction and operating valves to cause the first of the plurality of pumping chambers to move process fluid from the first of the plurality of pumping chambers into a fluid treatment unit, activating the actuation mechanism in a first direction and operating valves to cause a second of the plurality of pumping chambers to fill with process fluid from the fluid treatment unit, and activating the actuation mechanism in the second direction and operating valves to cause the second of the plurality of pumping chambers to move process fluid from the second of the plurality of pumping chambers to a dispense point. The first and second of the plurality of pumping chambers may operate at different pressures.

In another embodiment of the method above, for a pump comprised of an actuation mechanism for pumping actuating fluid, a plurality of pumping chambers, and a plurality of actuating fluid chambers, each actuating chamber in fluid communication with the actuation mechanism through at least one fluid communication channel permitting flow of actuating fluid between the actuating chamber and actuating mechanism, each of the plurality of pumping chambers including at least one process fluid inlet and one process fluid outlet, a method is provided. The method includes the steps of charging each of the plurality of pumping chambers with process fluid, activating the actuation mechanism in a first direction and operating valves to cause a first of the plurality of pumping chambers to fill with process fluid from a source, selectively opening for process fluid flow at least one outlet valve for at least one of the plurality of pumping chambers, and closing the at least one outlet valve for all remaining pumping chambers to create back-pressure of process fluid in the pumping chambers to prevent actuating fluid from flowing into associated actuating chambers. Actuating fluid flows only into the pumping chambers having at least one outlet valve opened, resulting in displacement of process fluid from the associated pumping chamber. The first and second of the plurality of pumping chambers may operate at different pressures.

In another embodiment of the present invention, a pump for use in handling one or more different process fluids is provided that includes a plurality of pumping chambers, each pumping chamber including at least one process fluid inlet and at least one process fluid outlet, the at least one process fluid outlet on each pumping chamber coupled to at least one process fluid valve on each pumping chamber for selectively preventing and allowing the flow of process fluid through the pumping chamber. The pump further includes an actuation mechanism for pumping actuating fluid to a plurality of actuating fluid chambers, the actuation mechanism in fluid communication with the plurality of actuating fluid chambers to permit flow into each actuating fluid chamber of substantially incompressible actuating fluid. The pump further includes at least one diaphragm separating each pumping chamber from an associated actuating fluid chamber, for separating process fluid from actuating fluid. The actuation mechanism is removable by a quick disconnect connection that provides for disconnection of the actuation mechanism without affecting process fluid in the process fluid inlet, process fluid outlet, process fluid valve, or process fluid in each pumping chamber. Operation of the actuation mechanism to displace actuating fluid causes actuating fluid to flow only into each of the plurality of actuating fluid chambers having an opened process fluid valve, resulting in pumping.

A plurality of isolation valves may be used where each isolation valve is located between the actuating mechanism and one of the plurality of actuating fluid chambers for selectively preventing and allowing the flow of process fluid between the actuating mechanism and one or more selected actuating fluid chambers. Each isolation valve may be a proportional control valve to enable dispensing out of more than one pumping head simultaneously, at, at least one flow rate using a single one of the actuating mechanism.

In another embodiment of the present invention, a pump for use in handling one or more different process fluids is provided that includes an actuation mechanism for pumping actuating fluid, wherein the actuation mechanism is removable by a quick disconnect connection that provides for disconnection of the activation mechanism without affecting process fluid in the process fluid inlet, process fluid outlet, process fluid valve, or process fluid in each pumping chamber. Additionally provided are a plurality of pumping chambers and a like plurality of actuating fluid chambers forming a plurality of pairs of pumping chambers and actuating fluid chambers, each pair having one of the pumping chambers adjacent one of said actuating fluid chambers, each pumping chamber including at least one process fluid inlet and at least one process fluid outlet. Further provided are a diaphragm associated with each pair, located between the pumping chamber and actuating fluid chamber, for separating process fluid from actuating fluid, each actuating fluid chamber in fluid communication with the actuation mechanism permitting flow into the actuating fluid chamber of substantially incompressible actuating fluid, and the at least one process fluid outlet on each pumping chamber coupled to at least one process fluid valve associated with each pumping chamber for selectively preventing and allowing the flow of process fluid through the pumping chamber. Operation of the actuation mechanism to displace actuating fluid causes actuating fluid to flow only into each of the plurality of actuating fluid chambers having an opened process fluid valve, resulting in pumping.

A plurality of isolation valves may be provided where each isolation valve is located between the actuating mechanism and one of the plurality of actuating fluid chambers for selectively preventing and allowing the flow of process fluid between the actuating mechanism and one or more selected actuating fluid chambers. Each isolation valve may be a proportional control valve to enable dispensing out of more than one pumping head simultaneously, at least one flow rate using a single one of the actuating mechanism.

In another embodiment of the present invention, a pump for use in handling one or more different process fluids is provided that includes an actuation mechanism for pumping actuating fluid, wherein the actuation mechanism is removable by a quick disconnect connection that provides for disconnection of the actuation mechanism without affecting process fluid in the process fluid inlet, process fluid outlet, process fluid valve, or process fluid in each pumping chamber. Further included are a plurality of pumping chambers and a like plurality of actuating fluid chambers, forming a plurality of pairs, each pair having one of the pumping chambers adjacent one of the actuating fluid chambers, each pumping chamber including at least one process fluid inlet and at least one process fluid outlet. Further included are a diaphragm associated with each pair, located between the pumping chamber and actuating fluid chamber, for separating process fluid from actuating fluid, each actuating fluid chamber in fluid communication with the actuation mechanism to provide for flow into each actuating fluid chamber of substantially incompressible actuating fluid, the process fluid inlet on a first one of the pumping chambers in communication with a source of process fluid, the process fluid outlet on the first one of the pumping chambers in communication with the process fluid inlet on a second one of the pumping chambers, the process fluid outlet on the second one of the pumping chambers in fluid communication with a dispense point, each pumping chamber coupled to at least one process fluid valve on each pumping chamber for selectively preventing and allowing the flow of process fluid through the pumping chamber. Operation of the actuation mechanism to displace actuating fluid causes actuating fluid to flow only into each of the plurality of actuating fluid chambers having an opened process fluid valve, resulting in pumping.

A plurality of isolation valves may be provided where each isolation valve is located between the actuating mechanism and one of the plurality of actuating fluid chambers for selectively preventing and allowing the flow of process fluid between the actuating mechanism and one or more selected actuating fluid chambers. Each isolation valve may be a proportional control valve to enable dispensing out of more than one pumping head simultaneously, at least one flow rate using a single one of the actuating mechanism.

Finally, a pump for use in handling one or more different process fluids is provided that includes a plurality of pumping chambers, each pumping chamber including at least one process fluid inlet and at least one process fluid outlet, the at least one process fluid outlet on each pumping chamber coupled to at least one process fluid valve on each pumping chamber for selectively preventing and allowing the flow of process fluid through the pumping chamber, at least one an actuation mechanism to apply a force to each of the pumping chambers to cause process fluid through each of the pumping chamber, resulting in pumping, and a plurality of isolation valves, each isolation valve for selectively preventing and allowing the flow of process fluid. Each isolation valve may be a proportional control valve to enable dispensing out of more than one pumping head simultaneously, at least one flow rate using a single one of the actuating mechanism.

DETAILED DESCRIPTION OF INVENTION

Figure 1:
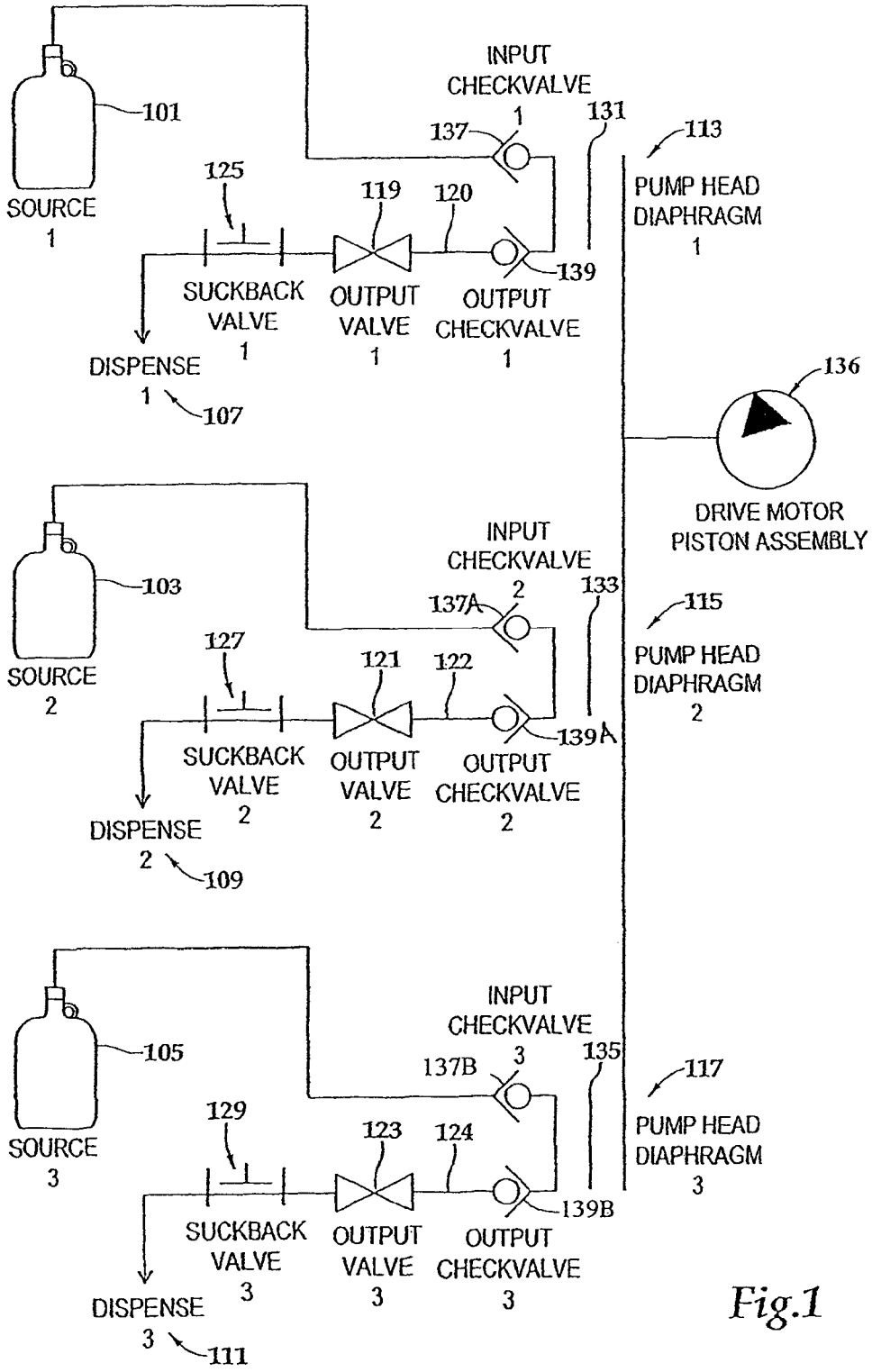
FIG. 1 is a schematic view of a single stage, multiple head pump, shown in the context of a high precision, high-purity fluid dispensing system in accordance with a first preferred embodiment of the present invention.

FIG. 1 schematically illustrates one example of a high precision, single stage, multiple head dispense pump for pumping a plurality of different chemicals in a high purity application. A pumping head is a portion of a pump that, among other possible functions, contacts and applies force to the process fluid in order to move it. In a high precision, multiple head pump, more than one pumping head is actuated by a common actuation mechanism. In the illustrated example, a multiple head pump is used to dispense chemicals or process fluids from three separate sources 101, 103 and 105 to each of three separate dispense points 107, 109 and 111, respectively. Each source and dispense point is coupled through a pump head 113, 115, or 117. Each pump head functions to move a predetermined amount of fluid from the source to the corresponding dispense point. Because each pump head functions independently and does not share with the other pump heads any surfaces that contact process fluids, each source can be a different type of chemical. Output valves 119, 121, and 123 open and close output lines 120, 122, and 124, respectively, between the pump heads 113, 115 or 117 to their corresponding dispense points 107, 109, 111. Each is independently controlled by a controller (not shown) that coordinates opening of the valve with pump operation. Because the illustrated pump is employable to particular advantage in semiconductor manufacturing operations, where chemicals are pumped to a dispense point for dispensing onto a semiconductor wafer, the output valves 119, 121, 123 in the illustrated example are coupled to suck back valves 125, 127 and 129. After a dispense, a suck back valve 125, 127, 129 is used to draw fluid back from a dispense point 107, 109, 111 nozzle, or similar element in order to prevent dripping.

In the illustrated example, the pump heads move process fluid by drawing it into a pumping chamber (integral to the pump head) and then displacing the process fluid. Positive displacement is advantageous for applications requiring precise metering of fluid. The volume of each pumping chamber is increased to suck in process fluid, and then decreased to push it out. A member that is used to change the volume of a chamber will be called a displacement member. A pumping chamber and displacement member can be implemented a number of different ways. One example includes a piston or piston-like device moving within a cylinder. The instant example contemplates use of flexible diaphragm as a displacement member that cooperates with the walls of the pumping chamber. Moving the diaphragm in one direction increases the volume of the pumping chamber, and moving the diaphragm in another direction decreases the volume of the pumping chamber. The diaphragms for pump heads 113, 115 and 117 are schematically illustrated in the figure as elements 131, 133 and 135, respectively.

A number of different arrangements can be used to ensure that fluid flows only in one direction through the pump head 113, 115, 117. In the illustrated example, the pump heads 113, 115, 117 include inlets (not indicated) for coupling the pump heads to the process fluid sources, such as sources 101, 103 or 105, and outlets (not indicated) for coupling the pump heads 113, 115, 117 to dispense points, such as dispense points 107, 109 or 111. The pumping chamber in each pump head has at least one opening, and preferably at least two openings, one being in communication with the inlet and the other in communication with the outlet. Fluid is drawn into the pumping chamber through the inlet opening and expelled through the outlet opening. This allows for creation of a generally unidirectional flow of process fluid through the pumping chamber, which can assist in reducing pooling of process fluid and accumulation of contaminants in the pump head. The inlet and outlet of each pump head is coupled through valving that ensures, at least during normal operation, that fluid flows into the pumping chamber only from the inlet and exists the pumping chamber only through the outlet.

The valving can take different arrangements, depending in part on the number of openings into the pumping chamber and other considerations. In the illustrated example, the valving is comprised of two valves. Check valve 137, 137A, 137B ensures one-way flow from the inlet into the pumping chamber, and check valve 139, 139A, 139B ensures one-way flow of process fluid exiting the chamber through the outlet. The check valves are self-actuating or lifting, which tends to reduce complexity by avoiding having to implement a mechanism for synchronizing their opening with the pumping action of the pump head 113, 115, 117. However, it might be advantageous in some circumstances, such as those described below, to incorporate valves whose opening can be independently controlled. Furthermore, use of check valves may not be appropriate for some applications. If the pumping chamber has only one opening, one example of suitable valving includes a three-way valve that selectively couples either the inlet or outlet to the opening, or closes the opening altogether, depending on the stroke of the pump. Other types of valving could be chosen to achieve the same functionality, although possibly at the expense of greater complexity and less reliability.

Each of the pump heads 113, 115, 117 shares a common actuation mechanism 136, represented in the figure by drive motor and piston assembly. An actuation mechanism includes a force generating component, such as a motor, and a coupling for communicating the force to a fluid displacement member. Sometimes, these components are one and the same. Examples of actuation mechanisms 136 include mechanical, pneumatic and hydraulic mechanisms and combinations of them. One example of a mechanical actuator is a driver motor coupled to a diaphragm through a purely mechanical coupling, such as a transmission or other mechanical linkage or piston. The linkage or piston converts the output of the motor into movement of the first displacement member. A hydraulic coupling can also be used, with the motor moving a piston, which in turn moves hydraulic fluid that pushes against the displacement member. In a purely pneumatic system, for example, gases under high pressure are used to move the displacement member.

In the illustrated example, the force generated by the common actuation mechanism 136 is preferably applied in parallel, rather than serially, to each of the pump heads 113, 115, 117. Although applying the force in parallel will lead all pump heads to actuate simultaneously, avoiding serial application of the force reduces the complexity by avoiding a mechanism for selectively applying or switching the actuation force between the pump heads. Complexity tends to increase costs and reduce reliability.

In order to avoid undesirable, simultaneous actuation of all pump heads 113, 115, 117, yet maintain simplicity, the actuation mechanism 136 in the illustrated example preferably utilizes a fluidic coupling for communicating forces from a motor or other force generating mechanism to the process fluid. The drive assembly for the actuation mechanism 136 in the illustrated example includes a drive (stepper) motor (not shown) for supplying force for moving the actuating fluid. The drive motor moves a displacement member (e.g., a piston) that, in turn, moves fluid in a manner that causes the pump head to actuate. Actuating fluid is moved in and out of a chamber on the side of the diaphragm opposite the pumping chamber. Displaced actuating fluid moves into the pump head, reducing the volume of the pumping chamber and pushing fluid out. Reverse movement of the displacement member causes the actuating fluid to flow from the pumping head, increasing the volume of the pumping chamber and consequently drawing in process fluid. If the fluid is not compressible at least at the pressures at which the pump functions (such fluid being referred to herein as incompressible), and only one pumping chamber is open, the amount of actuating fluid displaced by actuating assembly is proportional to the amount of process fluid displaced from within the pumping chamber.

Blocking flow of process fluid out of the pumping chamber of a pump head 113, 115, 117 in effect blocks the flow of actuating fluid into the pump head, thus causing actuating fluid to be redirected to, and to flow into, another pump head without internal valving to redirect the fluid to different pump heads. Therefore, although internal valving could be used, it is not required in order to ensure only one head is pumping at a time. In this example, a preexisting valve at the outlet a valve that would otherwise be present for this application is sufficient, therefore allowing reduction in complexity and the size of the pump without a corresponding increase in the number of external valves that would otherwise be required. Furthermore, existing external valving can be utilized for blocking process fluid flow through the pump heads. In the illustrated example, which uses self-actuating check valves, output valves 119, 121 and 123 are selectively closed to block flow of fluid from the pump heads that are not intended to be pumping during actuation of the pump. The output valves may be located anywhere along the line carrying fluid from the pump head to the dispense point. A controllable valve can be substituted for one or both check valves, or used in addition to them, if an output valve is not available or there is a preference not to use the output valve. However, this would be at the expense of more cost and complexity. Furthermore, other valving arrangements that are used to ensure one way flow of process fluid through the pump head, such as the three-way valve mentioned above, can be used also for this purpose.

Optionally, when used for metering fluids, the pump is operated so that only one pump head 113, 115, 117 is active at a time. All actuating fluid is thereby directed only into or out of the active pump head. By allowing actuating fluid to flow only out of one pump head at a time, the amount of process fluid being pumped may be determined from movement of the displacement member within the actuation mechanism. If more than one pump head is opened for pumping during actuation, a mass flow meter is coupled with the pump head to determine the amount of process fluid flowing out of the pump head. However, in applications such as semiconductor manufacturing dispense cycles are short and demand for dispense from a particular dispense point is not constant and, in some cases, relatively infrequent. Given the absence of internal valving for redirecting the actuating fluid and the simplicity of the mechanism controlling flow of process fluid through a pump head, fast activation of pump heads is possible, thus allowing the actuating fluid to be, in effect, time multiplexed to the pump heads without unduly slowing dispensing.

Referring now to FIGS. 2 through 9, an exemplary single-stage pump 200 is shown comprised of an exemplary structure for the multi-head pump shown in FIG. 1, suitable for high purity applications, such as those in semiconductor manufacturing. The pump 200 includes, in this example, three pumping head structures 202, 204 and 206, which cooperate with a central body 208 to form respective pump heads. In this example, the pumping head structures 202, 204, 206 are arrayed around a central body 208. In other preferred embodiments, the pumping head structures 202, 204, 206 need not be arrayed around the central body 208. The central body 208 supports the pumping head structures 202, 204, 206 and preferably also provides channels in the form of holes or passageways through the central body 208 for supplying actuating fluid to each pump head. By integrally forming the fluid passageways as part the body, such as by machining a monolithic block, additional connections can be avoided, thus reducing the risk of a leak of actuating fluid. In high purity applications such as semiconductor fabrication, even the smallest leak may contaminate the clean environment and is therefore very undesirable.

The central body 208 in the illustrated example possesses a square cross-section with four sides. Formed on three of the four sides are faces to which the pumping head structures 202, 204, 206 are coupled. The fourth side is used, in this example, to receive a pressure sensor 210. The pressure sensor 210 is used to measure the pressure of actuating fluid within the actuation mechanism. Arraying the pumping head structures 202, 204, 206 at least partially around channels supplying actuating fluid tends to result in more efficient utilization of space as compared to, for example, a configuration in which the heads are arranged in a linear fashion. However, other advantages of the exemplary pump illustrated in these figures can be achieved without the pumping heads being arrayed around the central body 208. For example, the pumping head structures can be arranged in a stacked configuration. More pumping head structures can be coupled to the central body 208 by increasing the cross-sectional size, increasing the number of faces disposed around the central body 208, by reducing the size of the pumping head structures 202, 204, 206, and/or by extending the body 208 along its central axis. The size of the pumping head structures 202, 204, 206 depends in part on the desired volume of the pumping chamber within each pumping head structure. Preferably, the size of the pumping chamber is such that multiple, incremental dispenses, in which only a portion of the process fluid within the pumping chamber is dispensed during a dispense cycle, are completed before having to draw in more fluid. A face need not be flat, but can be curved if desired. Thus, for example, the central body 208 can have either a polygonal or a generally circular cross section. Although a circular cross-section may take up less space, flat faces have the advantage of a simpler fabrication and connection with the pumping head structures 202, 204, 206.

The central body 208 preferably also houses, as in this example, at least one actuation mechanism, for example, a hydraulic actuation mechanism. The actuation mechanism includes an actuating fluid reservoir as well as a displacement element. In the illustrated embodiment, the actuating fluid reservoir is comprised of a cavity 207 (see FIG. 5) of circular cross-section formed within the center of the block forming body 208, and the displacement element is comprised of several elements functioning as a piston and generally designed by reference number 209. Placing the actuation mechanism in the central body 209 makes most efficient use of space and avoids external connections. However, all or part of the actuation mechanism could, alternatively, be located outside support body 208 and coupled, for example, hydraulically, with the pumping head structures 202, 204, 206, with the loss of certain advantages of the preferred embodiment, such as loss of compactness and greater complexity and risk of contamination from leaks due to increased numbers of connections. For example, if the axial length of a body 208 is extended by joining multiple blocks, the actuation mechanism could be located in one of the blocks and hydraulically coupled with the other block through a passageway or external line.

In the illustrated embodiment, pumping head structures 202, 204 and 206 are coupled respectively with a face portion 211 formed on each of three side walls of body 208.

Figure 2:
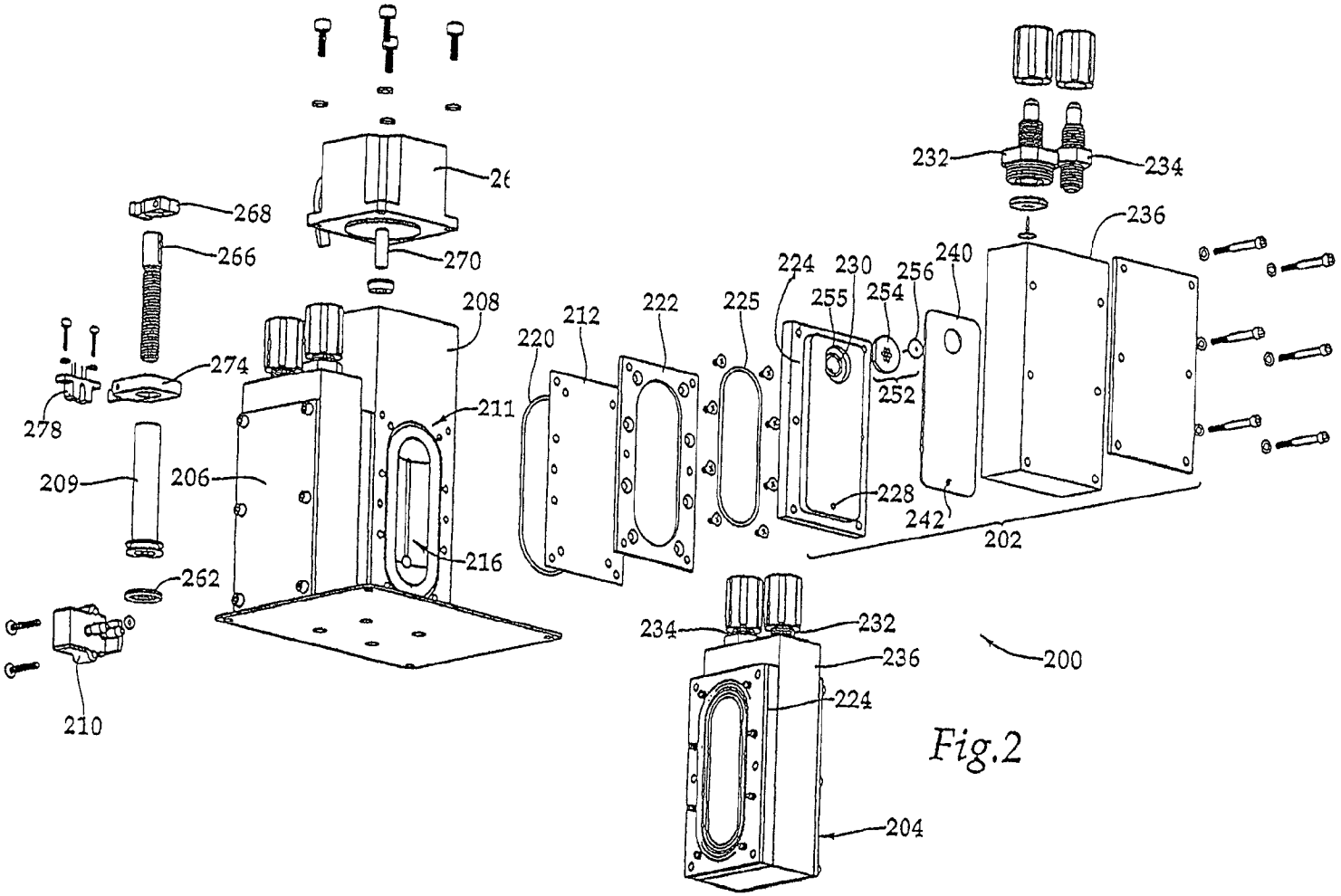
FIG. 2 is an exploded isometric view of the multiple head pump of FIG. 1.
Figure 3:
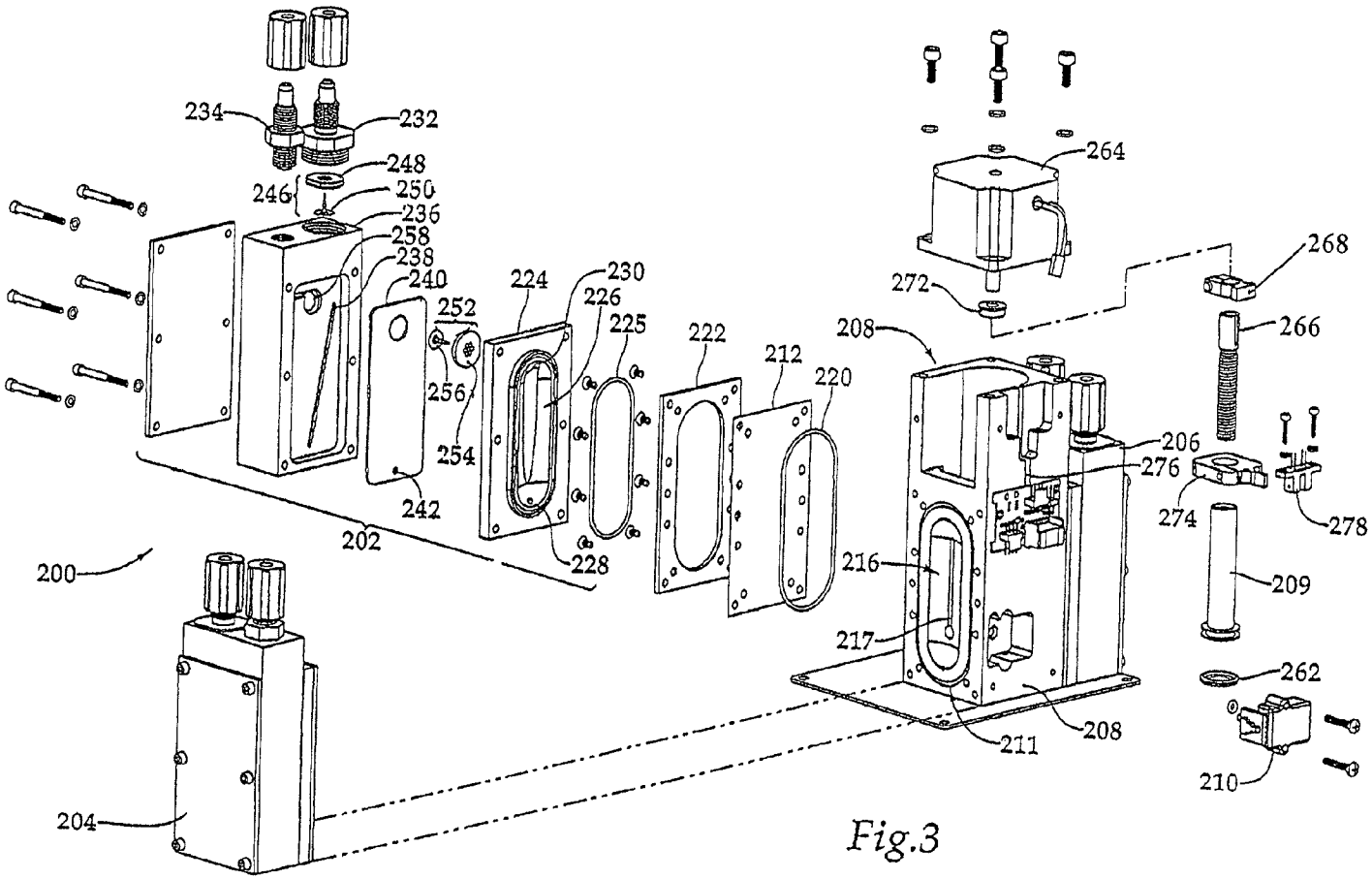
FIG. 3 is an exploded view of the multiple head pump of FIG. 1, shown from a different angle of the multiple head pump of FIG. 2.
Figure 4:
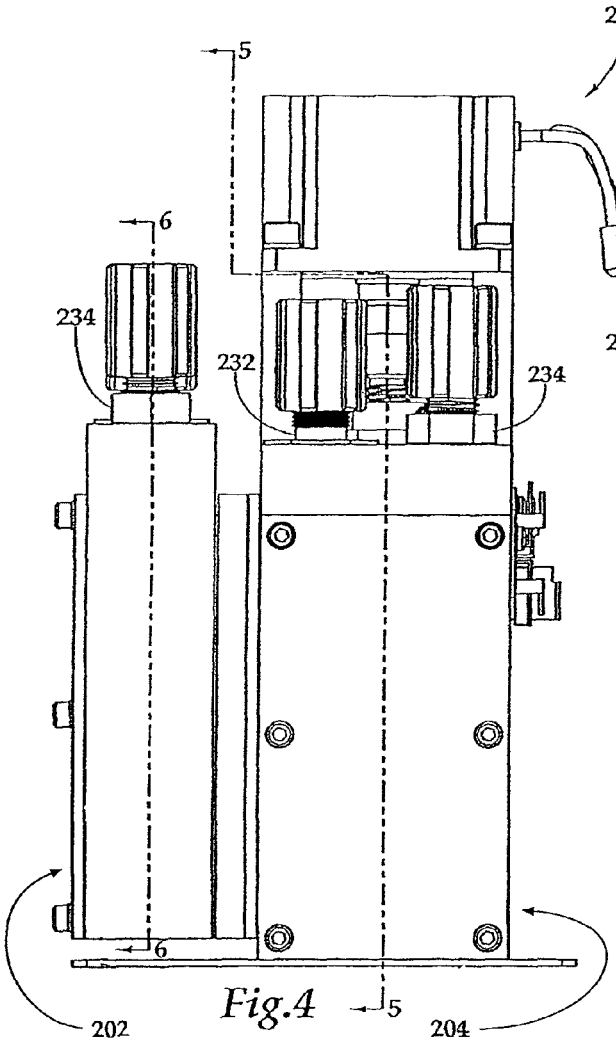
FIG. 4 is a side, elevation view of the pump of FIGS. 2 and 3, assembled.
Figure 6:
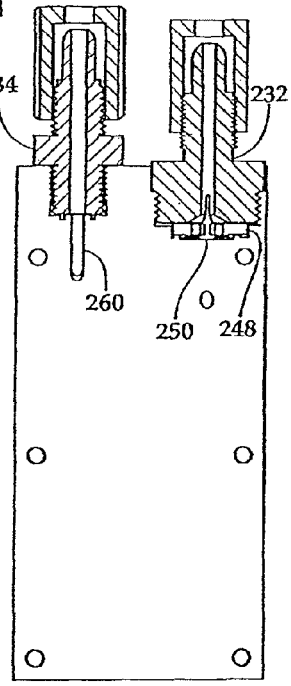
FIG. 6 is a cross-sectional view of the pump of FIG. 4 taken along section line 6-6 of FIG. 4.
Figure 5:
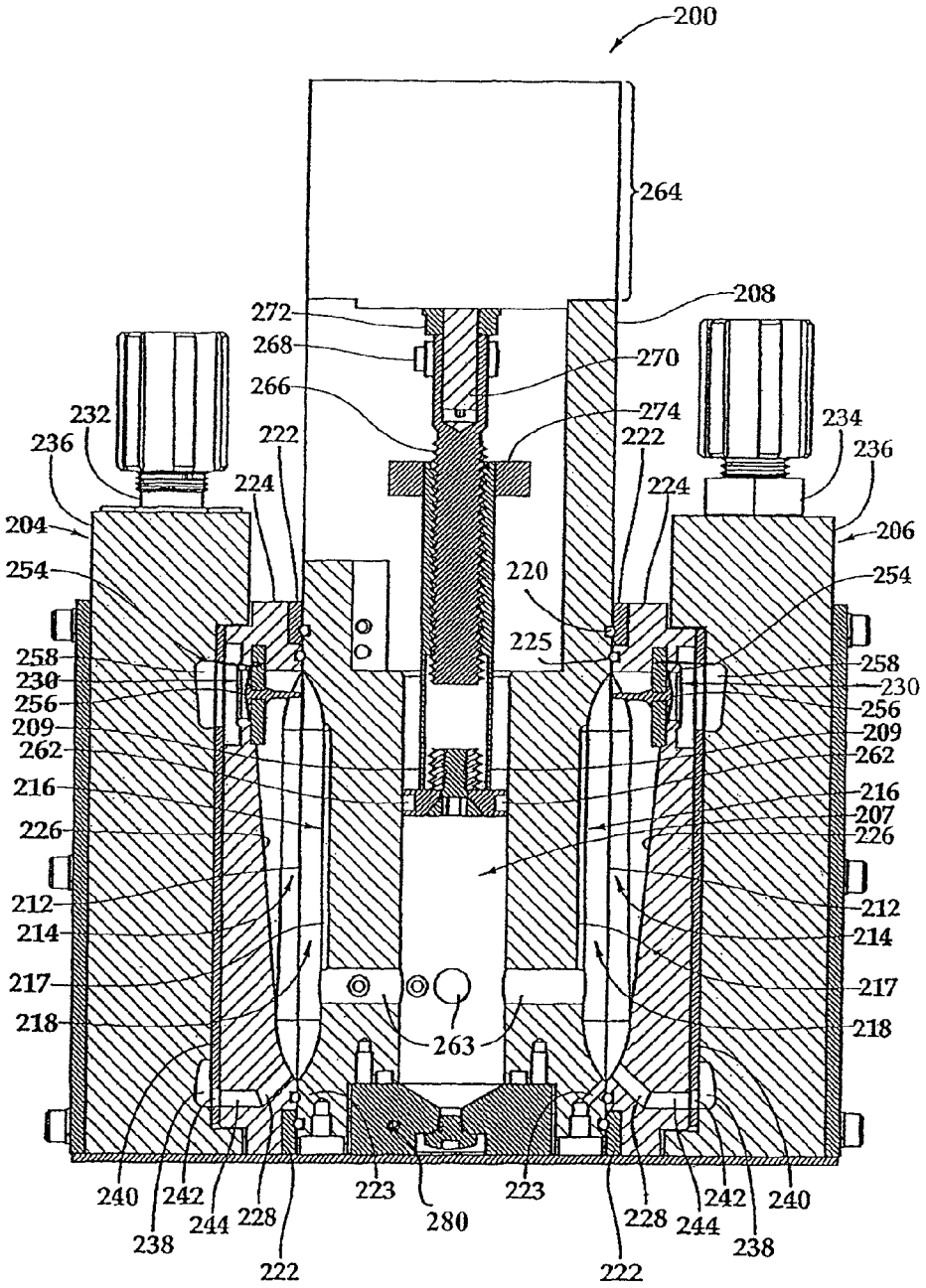
FIG. 5 is a cross-sectional of the pump of FIG. 4, taken along section line 5-5 of FIG. 4.
Figure 7:
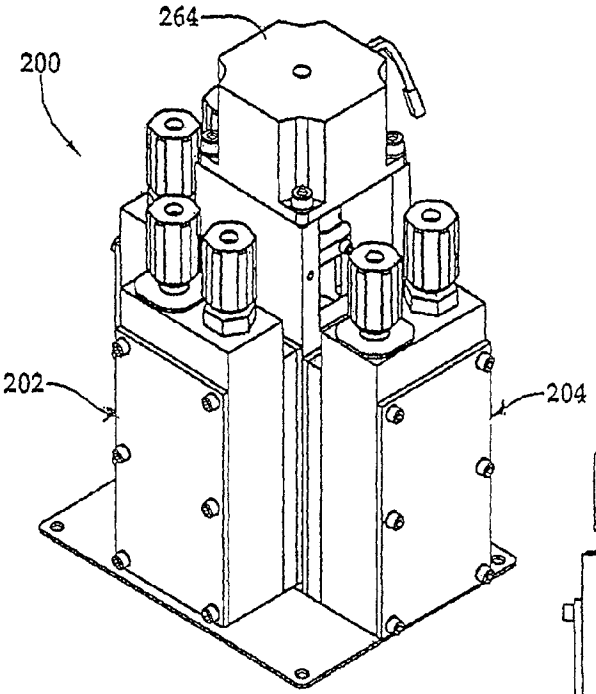
FIG. 7 is an isometric view of the pump of FIG. 4.
Figure 8:
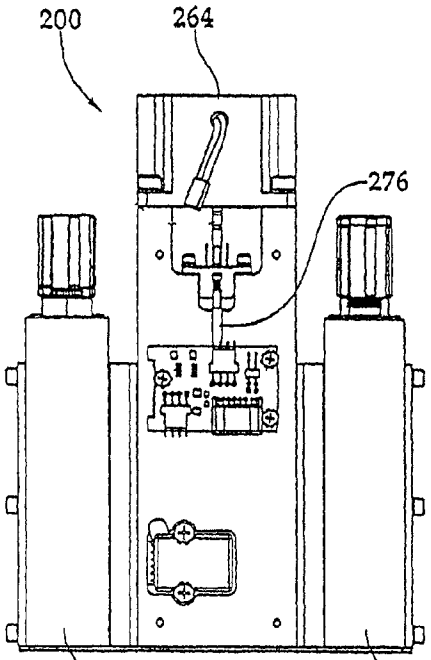
FIG. 8 is a front elevation view of the pump of FIG. 4.
Figure 9:
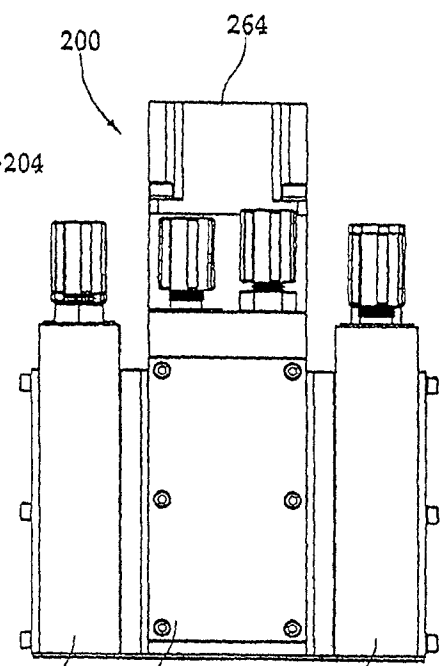
FIG. 9 is a rear elevation view of the pump of FIG. 4.

In each of the pumping head structures 202, 204, 206, diaphragm 212 extends across the face portion 211 and cooperates with a pumping head structure 202, 204, 206 to define a pumping chamber 214 (see FIG. 5) on one side of the diaphragm 212, and with a depression 216 (see FIG. 5) formed in the body 208, at the face portion 211, to define an actuating fluid chamber 218 (see FIG. 5) on the opposite side of the diaphragm 212. In this preferred embodiment of the exemplary pump 200, the diaphragm 212 can be easily removed and replaced by removing the pumping head assembly 202, 204 or 206. The diaphragm 212 is sealed against the cooperating face portion 211 of body 208 by O-ring seal 220. Plate 222 attaches the diaphragm 212 to the face portion 211 of the body 208. Among other advantages, attaching the diaphragm 212 with the plate 222 allows the pump 200 to be built and charged with actuating fluid—preferably a substantially incompressible fluid (at least at the pressures typically encountered in the application), such as glycol—prior to the pump head structures 202, 204, 206 being assembled with the body 208. The diaphragms 212 are preferably made from a translucent material in order to permit visual identification of any air or gas bubbles within the actuating fluid prior to attaching the pumping head structures 202, 204, 206. Although one diaphragm 212 per pumping head structure 202, 204, 206 is being used in the illustrated embodiment, two or more adjacent pumping head structures 202, 204, 206 could instead use a different area of one, larger diaphragm 212, isolated by a seal or other structure, so that process fluid does not leak between the pump head structures 202, 204, 206. As seen in FIGS. 2 and 5, vent line 223 permits air to be purged from the actuating fluid chamber 218. Vent lines 223 are sealed with plugs that are not shown in the figures. Air entrapped in the actuating fluid and/or process fluid, pumping chamber, actuating fluid chamber 218, cavity 207 or any of the channels within the pump carrying the fluids, can also be detected by charging the pumping chambers 214 with process fluid, closing each of them so that process fluid cannot flow out, pumping the actuating fluid and monitoring the pressure of the actuating fluid using pressure sensor 210. Because air bubbles are compressible, the measured pressure will be less than expected if a substantial amount of air is entrapped in the system.

Each pumping head structure 202, 204 and 206 is an assembly that includes a pumping chamber cover 224 with a cavity or depression 226. The cover 224 cooperates with the diaphragm 212 to form pumping chamber 214. O-ring 225 forms a seal between the cover 224 and diaphragm 212. Inlet orifice 228 and outlet orifice 230 extend through cover 224 for permitting flow of process fluid into and out of, respectively, the pumping chamber 214. The inlet orifice 228 is located near the bottom of the pumping chamber 214 so that fluid flows upward, against gravity, when the pump 200 is in a normal operating position, toward the outlet orifice 230. This arrangement and the elongated form of the pumping chamber 214 tends to reduce pooling of process fluid within the pumping chamber 214 and encourages migration of bubbles toward the outlet to assist with purging. The generally curved shape of the depression 226 and obtuse angles at the junctions of straight surfaces within the pumping chamber 214 avoid sharp corners in which process fluid and micro-bubbles might collect and be difficult to purge, thus further reducing the risk of entrainment of bubbles during normal operation.

Each pumping head structure 202, 204, 206 includes connectors for connecting lines carrying process fluid into and out of the pumping head structure 202, 204, 206. In order to save space, the connectors are preferably oriented in a direction that is generally parallel to the elongated axis of the pumping chambers 214 and the body 208. If oriented with their axes perpendicular to the axis of the body 208, the pump 200 would occupy more space in lateral directions, and additional space would be required to accommodate the process fluid lines that will be connected to the inlet and outlet connectors. Inlet fitting 232 and outlet fitting 234 are threaded into a connector block 236. The illustrated inlet and outlet fittings 232, 234 are examples of flare type fittings typical in semiconductor manufacturing. They are intended to be representative generally of fittings for connecting lines to the pump. Other types of fittings can be used, depending on the application. Other examples of high purity fittings used in the semiconductor industry include Super Type Pillar Fitting® and Super 300 Type Pillar Fitting® of Nippon Packing Co., Ltd., Flowell® flare fittings, Flaretek® fittings from Entegris, "Parflare" tube fittings from Parker, LQ, LQ1, LQ2 and LQ3 fittings from SMC Corporation, Furon® Flare Grip® fittings and Furon® Fuse-Bond Pipe from Saint-Gobain Performance Plastics Corporation. The connector block 236 and the cover 224 are, in this example, fabricated separately and assembled into a pumping head assembly 202, 204, 206. However, the assembly could be fabricated using fewer or more components.

The connector block 236 includes a passageway that carries fluid from the inlet fitting 232 into the connector block 236 toward the inlet orifice 228 of the pumping chamber 214. In this example, the passageway is formed by a channel 238 formed on the surface of block 236 and a cooperating gasket 240. The gasket 240 also seals the pumping chamber cover 224 with the connector block 236. A hole 242 allows fluid to flow into channel 244 (see FIG. 5) defined through the pumping chamber cover 224. Channel 244 terminates at inlet orifice 228.

In the illustrated example (see FIG. 3), a one-way check valve 246 is integrated into the connector block 236 that allows fluid to flow only from the inlet fitting 232 to the pumping chamber 214. The check valve 246 is inserted into the same bore as the inlet fitting 232. It is comprised of an orifice plate 248 and an umbrella-shaped valve 250 that cooperates with the orifice plate 248. The valve's stem attaches the valve 250 to the orifice plate 248. Fluid flowing under pressure through the holes in the orifice plate 248, toward the valve 250, tends to cause the edges of the valve 250 to curl up or lift, while the center of the valve 250 remains stationary. The valve 250 has an inverted shape. When it is assembled, the stem pulls the edges of the valve 250 against the orifice plate 248, thereby creating a seating force that presses the perimeter of the valve 250 against the plate 248. This forms a good seal. More details about this particular type of check valve can be found in commonly assigned U.S. patent application Ser. No. 11/612,408, filed on Dec. 18, 2006, which is incorporated herein by reference.

The connector block 236 also includes a passageway that carries fluid exiting pumping chamber 214 to the outlet fitting 234. It also incorporates a one-way check valve 252 that allows fluid flow in the direction of the outlet connector. Check valve 252 is substantially similar to check valve 246. It includes an orifice plate 254 that sits in a recess 255 (see FIG. 2) formed on the back of pumping chamber cover 224. Umbrella-shaped valve 256 is attached to the orifice plate 254. Fluid is flowing out of the pumping chamber 214, through the outlet orifice 230, flows through the check valve 252 and into a passageway that connects with outlet fitting 234. The passageway is formed in part by channel 258, formed in one surface of connector block 236, and cooperating gasket 240. Segment 260 (see FIG. 6) of the passageway connects to bore into which outlet fitting 234 is screwed. An initial portion of channel 258 preferably forms a volume large enough to accommodate deflection of the edges of the valve 252 and flow of fluid from around the edges of the valve 252 without restricting the flow.

As seen in FIG. 5, incompressible actuating fluid is stored in the central chamber or cavity 207 of the actuation mechanism. When displacement element 209 (piston) translates within the cavity 207, passageways 263 communicate fluid between the cavity 207 and an actuating fluid chamber 218 associated with each of the pumping heads 202, 204 and 206. Fluid is capable of moving in parallel between the cavity 207 and each actuating fluid chamber 218. Therefore, actuating fluid will, unless otherwise stopped, flow into each actuating chamber 218 when the piston displaces actuating fluid from the cavity 207. Similarly, actuating fluid will, unless otherwise stopped, flow out of the actuating fluid chamber 218 associated with each pumping head structure 202, 204, 206 when the piston is retracted, causing the actuating fluid to be drawn into the cavity 207.

Assuming that the pumping chamber 214 and the corresponding actuating fluid chamber 218 contain no gas, air or other compressible substance, flow of fluid through a given passageway is controlled in the illustrated embodiment by whether the diaphragm 212 is permitted to move. If it cannot move, actuating fluid will tend not to flow in either direction through the passageway between the cavity 207 and the actuating fluid chamber 218 that is associated with that diaphragm. Whether a diaphragm 212 moves depends on whether process fluid can be drawn into the pumping chamber 214 during flow of actuating fluid out of the actuating fluid chamber 218, and whether it can flow out of the pumping chamber 214 during flow of the actuating fluid from the cavity 207 and into the actuating fluid chamber 218. Given that process fluid can only flow in one direction through the pumping chamber 214 of the illustrated embodiment, opening and closing a valve (not shown in these figures) located in the outlet flow path for process fluid from the pumping chamber 214 will thus determine whether diaphragm 212 can be moved to displace the process fluid in the pumping chamber 214, which, in turn, determines whether actuating fluid flows into the actuating fluid chamber 218 for the given pumping head structure 202, 204, 206. By opening the outlet valve of only one pumping head structure, 202, 204, 206, all the actuating fluid caused by displacement of displacement element 209 (piston) will be forced to flow into only the actuating fluid chamber 218 of the pumping head structure 202, 204, 206 with the open outlet valve. The volume of actuating fluid displaced by movement of displacement element 209 (piston) will equal the volume of process fluid displaced by the diaphragm 212 of the pump head with the open outlet. In other words, there is a linear relationship between the movement of the piston and the volume of process fluid pumped.

As process fluid is always permitted to flow in to each of the pumping chambers 214 in the illustrated embodiment, actuating fluid will always flow from each actuating fluid chamber 218 during retraction of displacement element 209 (piston), at least until the diaphragm 212 reaches its full capacity. The wall forming depression 216 preferably includes a channel 217 to ensure that the diaphragm 212 has sufficient fluid behind it and allow flow, preventing the diaphragm from sticking to the wall. Thus, the illustrated embodiment of pump 200 will simultaneously recharge, or recharge in parallel, each pumping chamber in the pump, regarding less of the number of pumping head structures 202, 204, 206.

Displacement element 209 (piston) includes a sliding seal 262. Displacement of the piston within cavity 207 is preferably controlled by a stepper motor 264, which turns a drive screw 266. Clamp 268 attaches the drive screw to output shaft 270 of the motor 264. Thrust bearing 272 prevents the drive screw 266 from axially loading the output shaft 270 of the motor. The threads on the drive screw 266 couple with threads on the inside of the displacement element 209 (piston). The angular position of the piston is fixed by a guide 274, which is clamped to the piston (displacement element 209) and cooperates with slot 276 (see FIG. 3) to prevent rotation of the piston. Turning the drive screw 266 moves the piston. Other types of mechanisms for translating the piston could, however, be substituted. An optical sensor 278 (see FIG. 3) detects when guide 274, and thus piston (displacement element 209), is at a predetermined limit during upstroke. This is used to calibrate the pump 200. Cover 280 seals an opening that allows access to the cavity 207 for assembly and cleaning.

For semiconductor and other high purity applications, it is preferred that all surfaces of the pump that contact the process fluid are made of non-contaminating or non-reacting material. One example of such a material is polytetrafluoroethylene, which is sold by DuPont under the trademark Teflon®.

Figure 10:
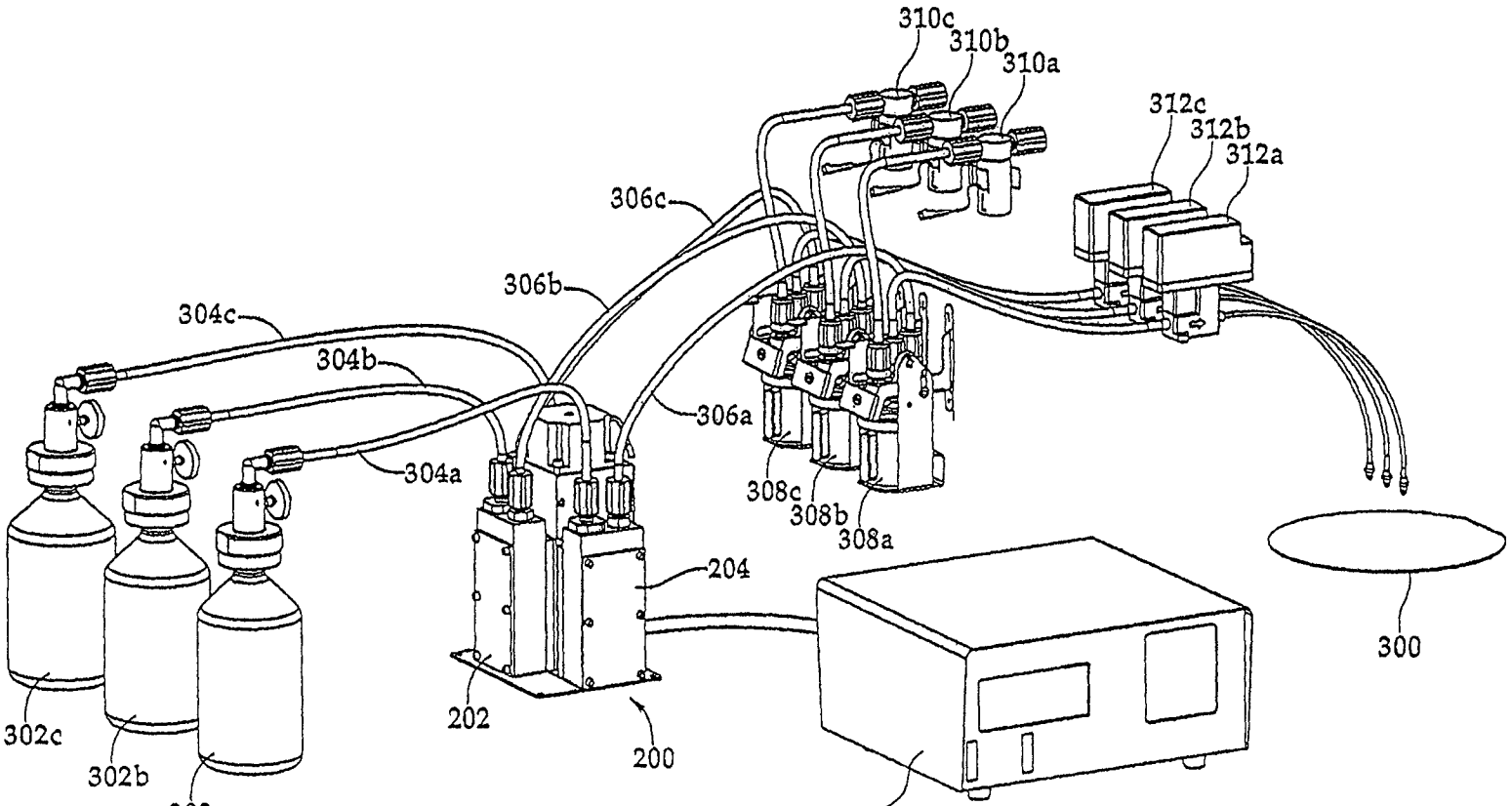
FIG. 10 is a simplified, isometric view of an application of the pump of FIGS. 2-9.

An exemplary application of multiple head dispense pump 200 is illustrated by FIG. 10. In this application, the pump 200 is used to dispense 3 different types of process fluids, used in the fabrication of integrated circuits, onto a semiconductor wafer 300. Each process fluid is stored in a container 302. The respective containers are numbered 302*a*, 302*b* and 302*c*. Each container supplies process fluid to one of the pumping head structures 202, 204 or 206. In this example, container 302*a* supplies pumping head structure 204 through supply line 304*a*; container 302*b* supplies pumping head structure 202 through supply line 304*b*; and container 302*c* supplies pumping head structure 206 through supply line 304*c*. Each of the supply lines is connected to the inlet fitting 232 (see FIG. 2) of the pumping head structure that it supplies with process fluid.

The outlet fitting 234 (see FIG. 2) of each of the pumping head structures 202, 204 and 206 is connected, respectively, to outlet lines 306*b*, 306*a*, and 306*c*. In this example, each outlet line is connected in series with a separate one of the filters 308*a*, 308*b* or 308*c*. Of course, not all three filters are required. Filtering (or otherwise treating) the process fluid is optional. Furthermore, less than all of the process fluids can be filtered, if desired. Each of the filters is connected to a separate purge valve 310*a*, 310*b* and 310*c*, respectively. The outlets of the filters are connected to dispense valves 312*a*, 312*b* and 312*c*, respectively. The dispense valves may include, optionally, integrated suck back valves. As best seen in FIG. 10, the outlet of each of dispense valves is connected to a respective nozzle, from which process fluid is dispensed onto wafer 300. Not all of the pumping head structures on pump 200 need to be used to service one wafer 300.

Figure 10A:
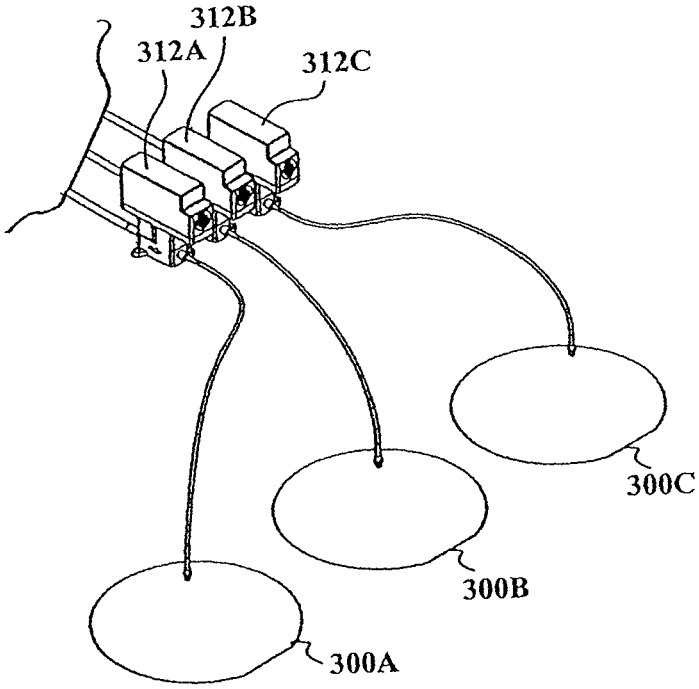
FIG. 10A is a partial isometric view of an alternate embodiment of the pump application shown in FIG. 10, but having three dispense valves dispensing fluid to three different semiconductor wafers.

The pumping head structures 200, 202, 204 may also be used, for example, to supply process fluid to more than one wafer 300A, 300B, 300C, as shown in FIG. 10A.

Operation of the pump 200 and dispense valves 312 are controlled by a controller 314. Preferably, the controller 314 is programmable and microprocessor-based, but could be implemented using any type of analog or digital logic circuitry. The same controller can be used to control more than one multi-head pump 200. The controller 314 typically receives a demand for dispense signal from a manufacturing line, where the wafer 300 is being processed. However, the control processes can be implemented in the line controller or other processing entity associated with the fabrication facility.

Figure 11A:
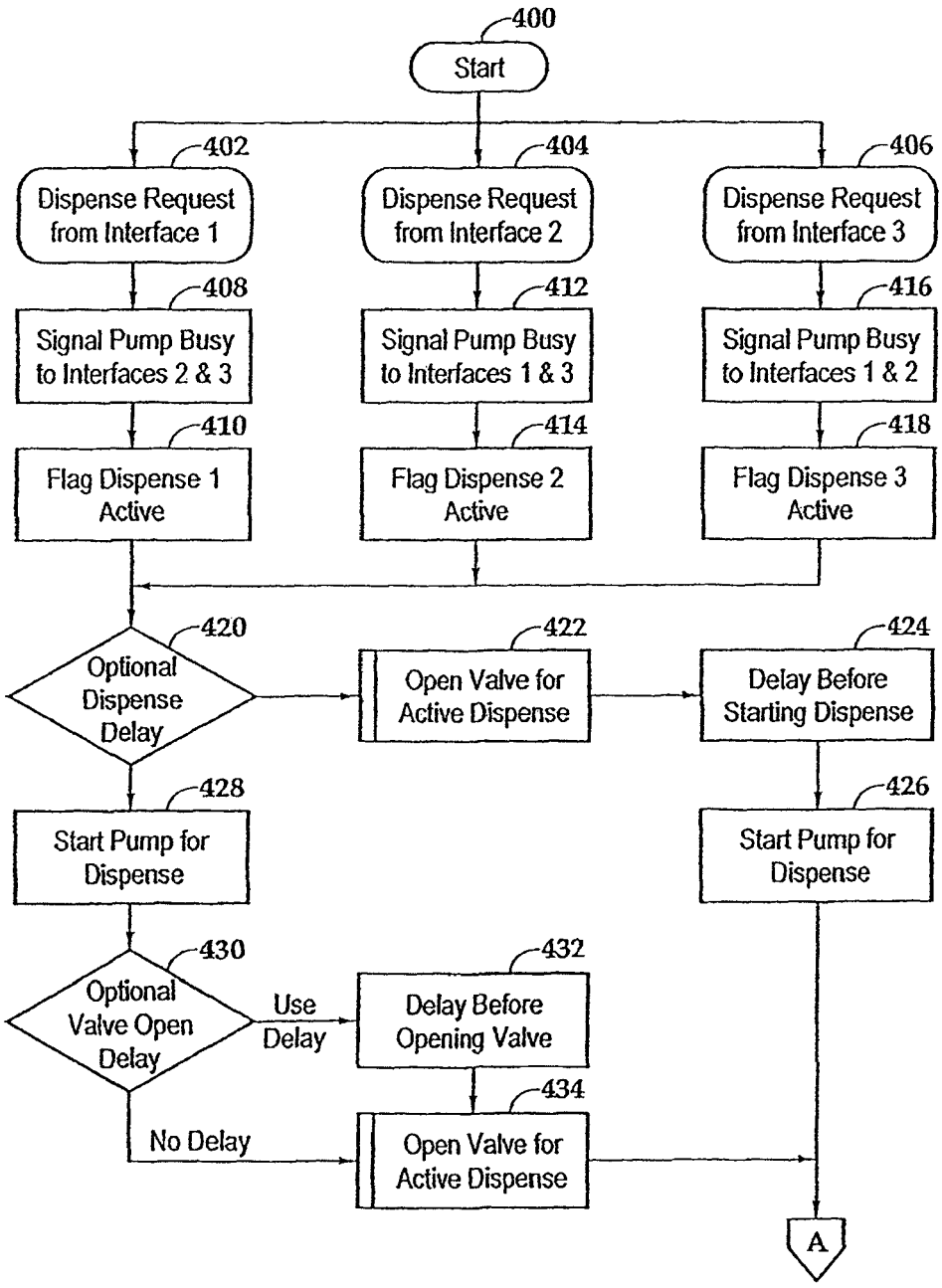
FIGS. 11A, 11B and 11C constitute a flow chart of an exemplary dispense process of a controller for the pump of FIGS. 2-9.
Figure 11B:
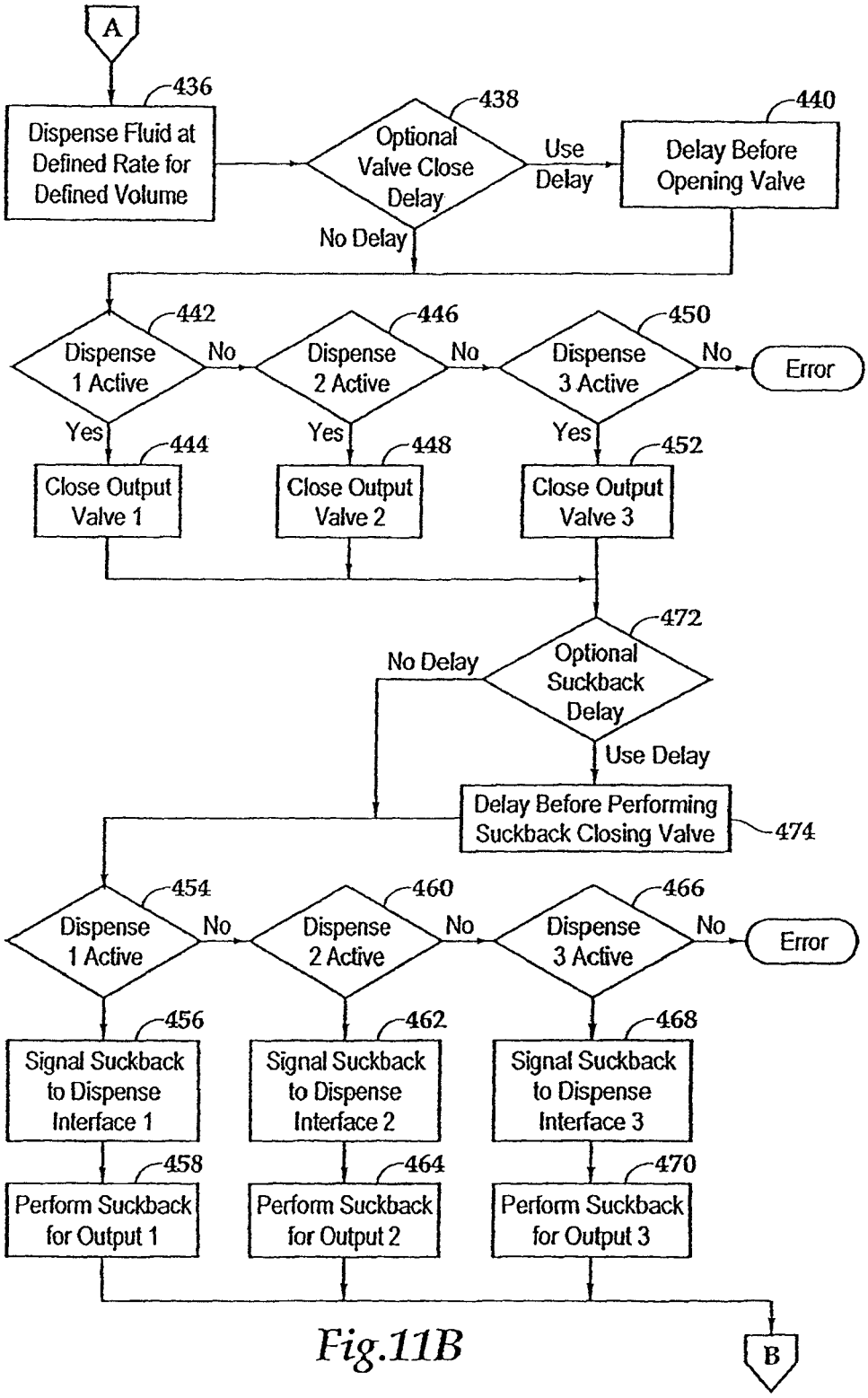
Figure 11C:
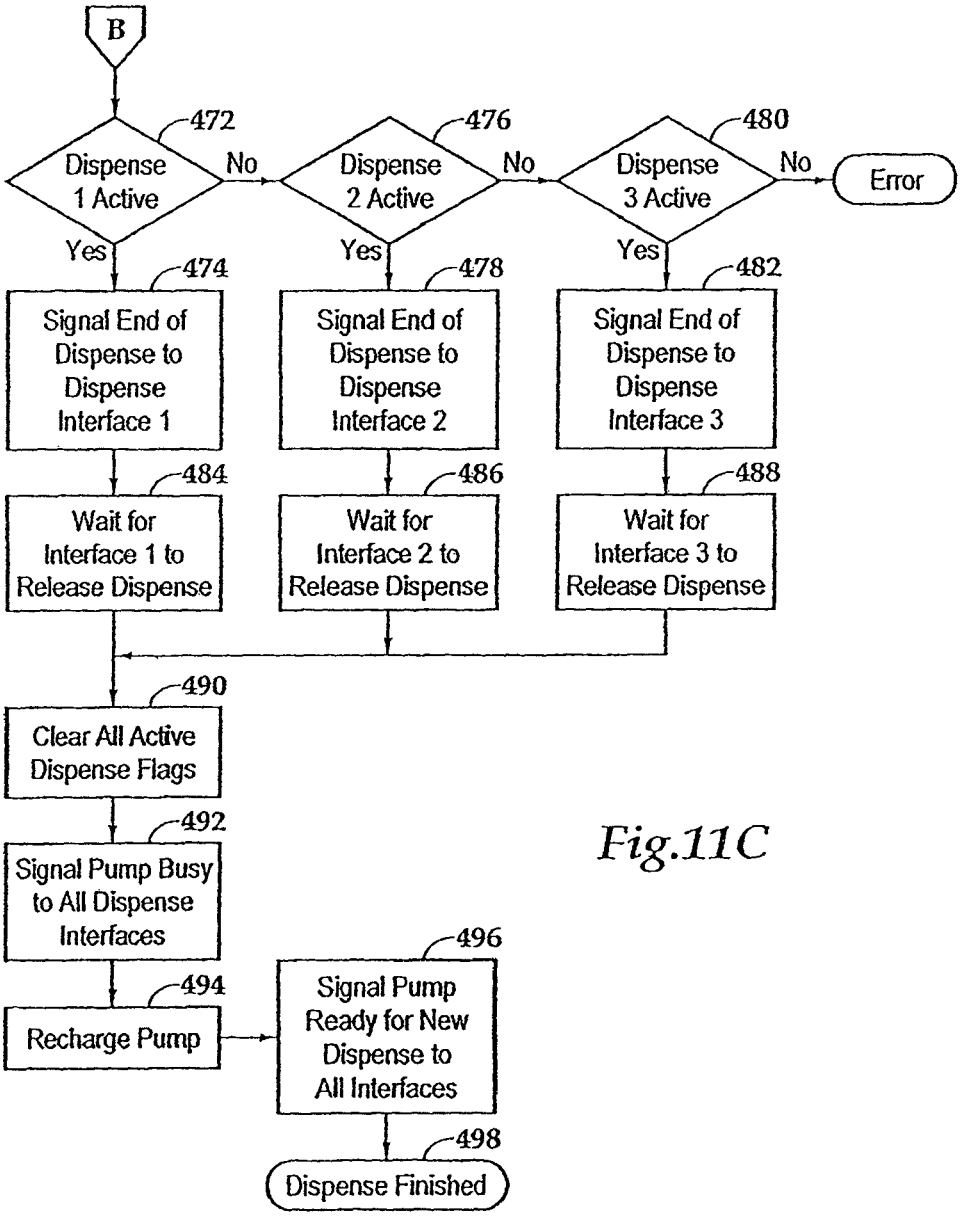

FIGS. 11A, 11B, and 11C are high level flow diagrams for an exemplary dispense mode control process of exemplary multi-head pump 200 of FIGS. 2-9 for the application illustrated in FIGS. 10 and 10A. The process takes place within the controller 314 when the controller is in a dispense mode. In this example, the controller 314 receives a request for dispense in the form of a signal sent to one of its interfaces. There are three interfaces in this example, corresponding to pumping head structures 202, 204 and 206 (see FIGS. 2-9). Each interface may include a physical communication interface. It may also store certain state information. Alternatively, the interfaces may also be implemented entirely logically or virtually. For example, the controller 314 may communicate with one or more tracks or other processing entities over one or more shared physical mediums, using addressable messages. The signal would be comprised of a message that identifies directly or indirectly a dispense head, such as by a logical port, address, or other identifier that the controller can map to a particular dispense head.

Starting with step 400 in FIG. 11A, when the controller receives a request for dispense of process fluid, as indicated by blocks 402, 404, and 406, the controller signals the other interfaces that the pump is busy and sets a flag indicating that dispense is active for that interface. Thus, if the request is received on interface 1, the controller communicates to interfaces 2 and 3 at step 408 that the pump is busy, so that production tracks or lines that communicate with it know that dispense is not available. It also sets at step 410 a stored flag, dispense 1, active. Similarly, if a dispense request is received on interface 2, a pump busy signal or state is communicated to interfaces 1 and 3 at step 412 and a dispense 2 flag is set active at step 414. Finally, if the request for dispense is received on interface 3, the pump busy signal or state is communicated to interfaces 1 and 2 at step 416, and the dispense 3 flag is set active at step 418.

As indicated by decision step 420, the controller determines whether there is an optional dispense delay set up or programmed for that interface. In a dispense delay, as indicated by steps 422, 424 and 426, the dispense valve corresponding to the active dispense flag is opened for a predetermined period of time prior to the pump being actuated. This might be used in applications in which, for example, it is desirable for the rate of dispense to start slow and then increase. If there is no dispense delay, the pump is started at step 428. The controller can be set up or programmed to open the dispense valve corresponding to the active dispense flag either immediately or after a predetermined or programmed delay, as indicated by steps 430, 432 and 434.

Once the dispense valve is opened and the pump is started, the controller actuates the pump so that a preset or otherwise determinable amount of process fluid is dispensed at a predefined rate or rates (the rate can be varied by, or a function of, time and/or other parameters, if desired), as indicated by step 436. In the embodiment illustrated in FIGS. 2-9, the controller steps the stepper motor 264 at a rate corresponding to the desired rate(s). The number of steps corresponds to the volume of process fluid to be dispensed. Once that volume is dispensed, the pump stops and the dispense valve corresponding to the active dispense flag is closed, as indicated by steps 442, 444, 446, 448, 450 and 452. The closing of the dispense valve can, optionally, be delayed, as indicated by steps 438 and 440. Once the active dispense valve is closed, the corresponding suck back valve is operated, as indicated by steps 454, 456, 458, 460, 462, 464, 466, 468 and 470, after an optional delay, as indicated by steps 472 and 474. The state of the suck back is communicated to the interface corresponding to the active dispense flag, as indicated by steps 456, 462 and 468.

Once suck back is completed, an end of dispense state or signal is communicated to the interface with the active dispense flag, as indicated by steps 472, 474, 476, 478, 480, and 482. The controller then waits for the interface to release the dispense, as indicated by steps 484, 486, and 488. The release occurs when the track or line controller signals acknowledges the end of dispense.

When the interface releases the dispense, the controller clears all dispense flags at step 490, communicates to all dispense interfaces that the pump is busy at step 492, and recharges the pump at step 494. To recharge the pump, the stepper motor is stepped in a direction opposite of the direction it is stepped for dispense, until the pumping chambers in each pump are fully charged. In the embodiment illustrated in FIGS. 2-9, an optical sensor 278 indicates when guide 274 is in a fully retracted position. This indicates that the piston 209 is retracted to the point at which enough of the actuating fluid is sucked out of each of the actuating fluid chambers 218 that the pumps are charged with the desired amount of process fluid. Typically, this will be when the diaphragm 212 is pulled close to the wall of depression 216 that partially forms the actuating fluid chambers. The pump is now full and ready to dispense again and a "Ready Signal is Sent" in step 496. The dispense cycle then ends at step 498, and the state of the controller returns to a start state indicted by step 400, in which the pump waits for a dispense request.

Referring now to FIGS. 12, 13, 14 and 15, other multi-headed pumps, such as the ones discussed above in connection with FIGS. 1-11 are shown in two-stage pumping systems. Four examples 500, 502, 504 and 505 of the two-stage pumping systems are illustrated, respectively, in FIGS. 12, 13, 14 and 15. Example 505 of FIG. 15 demonstrates two, two-stage pumps 505 arranged in parallel, with first stages that share one common actuation system, and second stages sharing a second, common actuation system. For convenience sake, the various elements of the second pump are designated with an "A" suffix in the figure to assist in distinguishing the first pump from the second pump. For example, the pumping chambers 506, 508 of the first pump are pumping chambers 506A, 508A of the second pump. Each of the remaining examples is of just a two-stage pumping system, with both stages sharing the same actuation mechanism.

In each of the examples of a two-stage pumping system, a pumping chamber 506 is used as a first stage, and a pumping chamber 508 is used as a second stage. The volume of each pumping chamber is changed to draw in and expel process fluid using a diaphragm, bellows, rolling diaphragm, tubular diaphragm or other arrangement. In examples 500, 502 and 504, pumping chambers 506 and 508 can be two different heads of a multi-headed pump, such as the one described in FIGS. 2-9. In the two, two-stage pumping systems 505, the first stage pumping chambers 506 of the respective two stage pump systems are, in the example, implemented with different heads on the same multi-headed pump. Similarly, the second stage pumping chambers 508 of these two, two-stage pumping systems are implemented by different heads on a second multi-headed pump. Additional heads on each multi-head pump could be used to drive the same stage of more than two, two-stage pumps, if desired.

The first stage of the pump is used to pull fluid from a source 509 and push it to a fluid treatment unit, such as a filter, generally designated by filter 510. The second stage is used for moving the fluid from the filtering system and dispensing it, in a metered fashion, onto, for example, a wafer 512. Fill valve 513 is opened to allow fluid to be drawn from the source 509 and into the first stage, and then closed when the first stage pumps. The fill valve can be alternatively implemented as a check valve. The filtering system typically includes a vent controlled in these examples by a valve 514, and a drain, controlled in these examples by a valve 516. Each of the examples also includes a dispense valve 518, for controlling dispensing, and an optional suck back valve 520. Each of the two-stage pumping systems in the examples includes a valve 522 for preventing reverse flow of processing fluid from the pumping chamber 508. A check valve is preferred. Two-way and other type valves can be substituted for the check valve, but they will need to be opened and closed synchronously with the operation of the pumping system, thereby complicating the control processes. Each two-stage pumping system includes a recirculation loop 521 that is opened and closed by recirculation valve 523. The two two-stage pumping systems 505 shown in FIG. 15 can be used to pump different types of process fluids to the same station, and onto the same wafer, as shown, in which case process fluid sources 509 would contain different types of process fluid. The two pumping systems can also be used to pump process fluids to multiple different stations.

Figure 12:
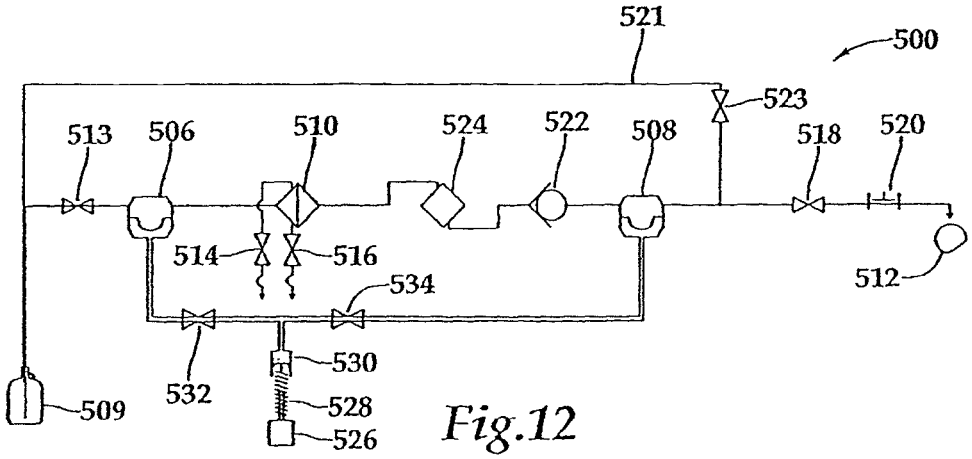
FIG. 12 is a schematic diagram of a two-stage pumping system utilizing a multi-head pump in accordance with a second preferred embodiment of the present invention.
Figure 15:
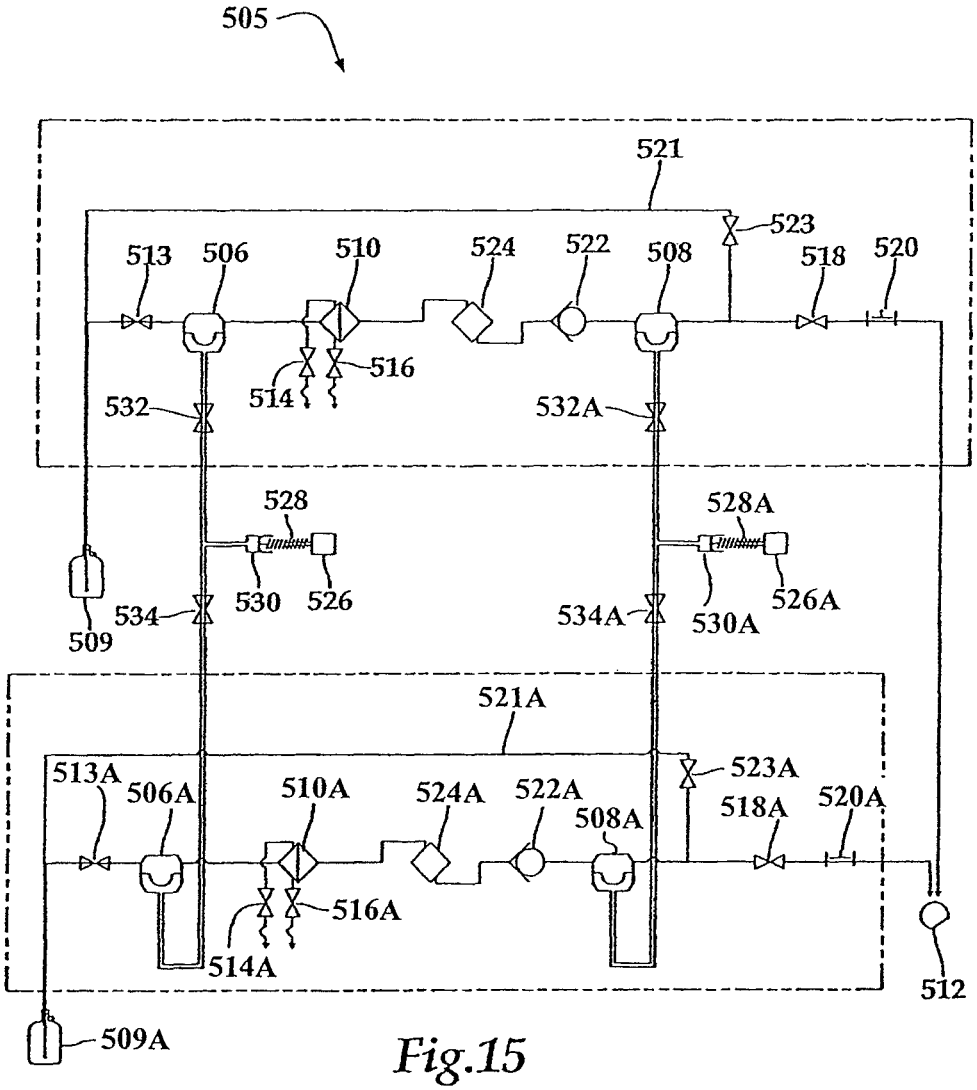
FIG. 15 is a schematic diagram of an example of a two-stage pumping system utilizing two or more multi-head pumps in accordance with a fifth preferred embodiment of the present invention.

The two-stage pumping systems 500 and 505 shown in FIGS. 12 and 15 also include reservoir 524 in series between the filter 510 and the second stage pumping chamber 508 of each of the systems. The reservoir is optional, and is only necessary if the filtering system cannot also act as a reservoir for receiving process fluid being pumped by the first stage.

In all examples 500, 502, 504 and 505, multiple pumping chambers are driven by a single actuation mechanism, which, in these examples, is comprised of stepper motor 526, turning a screw 528, which, in turn, causes translation of a piston within cylinder 530. In the two-stage pumping systems 500, 502 and 504, each actuation mechanism (stepper motor 526, screw 528, piston within cylinder 530) is coupled in parallel to pumping chambers 506 and 508. In the two-stage pumping systems 505, shown in FIG. 15, the first stage pumping chambers 506 are driven by a common actuation mechanism (stepper motor 526, screw 528, piston within cylinder 530), and the second stage pumping chambers 508 are driven by a second, common actuation mechanism.

For semiconductor and other high purity applications, it is preferred that all surfaces of the pump that contact the process fluid be made of non-contaminating or non-reacting material.

One example of such a material is polytetrafluoroethylene, which is sold by DuPont under the trademark Teflon®. Other examples include high density polyethylene and polypropylene and PFA (perfluoroalkoxy copolymer resin).

The actuation mechanism (stepper motor 526, screw 528, piston within cylinder 530) operates substantially similarly to the actuation mechanism described in connection with FIGS. 1-9. Actuation of an actuation mechanism causes actuating fluid to flow through fluid conduits extending between actuation mechanisms and each of the two pumping chambers in a manner described below. The conduits can be comprised of tubing, formed as passageways through blocks of materials, or other structures capable of communicating actuating fluid, and combinations of the foregoing. Surfaces contacting the actuating fluid do not need to be of a type for maintaining high purity, such as those required for the process fluid.

Figure 13:
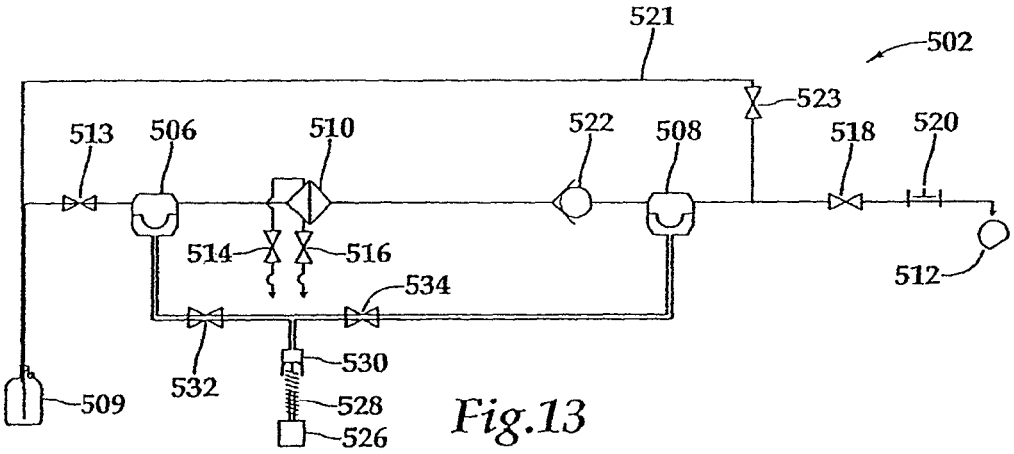
FIG. 13 is a schematic diagram of an alternate two-stage pumping system utilizing a multi-head pump in accordance with a third preferred embodiment of the present invention.

In two-stage pumping systems 500, 502 and 505, shown in FIGS. 12, 13 and 15, respectively, the actuation mechanisms (stepper motor 526, screw 528, piston within cylinder 530) are coupled to pumping chambers through valves 532 and 534. Valves 532 and 534 are used to control the flow of actuating fluid between the actuation mechanism of each of the two pumping chambers to which it is coupled. They permit selectively directing flow of actuating fluid only to one of the plurality of pumping chambers to which the pumping mechanism is coupled. A single three-way valve can be substituted for the two valves 532 and 534. Valves 532 and 534 are omitted from the two-stage pumping system 504 of FIG. 14. Instead, a first stage output valve 536 is inserted to permit selectively closing and opening the outlet of the pumping chamber. Closing the first stage pumping chamber prevents actuating fluid from displacing processing fluid from the chamber, thus effectively "locking" it against actuation, and thereby making it unnecessary to utilize valves 532 and 534. Although a coupling that utilizes valves 532 and 534 may complicate system timing, the valves do not have to be suitable for high-purity applications, like valve 536 would need to be. Therefore, they will be less expensive. Furthermore, valves 532 and 534 may enhance dispense accuracy. Therefore, although optional, they might be preferred for some applications.

The operation of the two-stage pumping systems, which is described below, is controlled by one or more controllers, executing predetermined control routines to open and close the various valves and to cause turning of the motor of the actuation mechanism.

Referring now only to FIGS. 12 and 13, operation of each of the two-stage pumping systems 500 and 502 will be first described. Assuming that each system is completely primed and full of process fluid, all valves are closed and a unit is ready to process a first wafer. Dispense valve 518 is opened. Actuating fluid valve 534 for the second stage is also opened. Drive motor 526 turns drive screw 528, moving the piston in cylinder 530. The piston advances forward, pushing actuating fluid out of the cylinder 530. Blocked by closed first stage actuating fluid valve 532, the actuating fluid moves through valve 534 and into pumping chamber 508, causing movement of a process displacement member, such as some type of diaphragm. As the actuating fluid moves in, it displaces an equal volume of process fluid. The process fluid exits the chamber 508. It is blocked by check valve 522, so it flows through output valve 518 and out a dispense tip onto the wafer 512. Output valve 518 is then closed after the dispense is finished. The motor 526 reverses direction, pulling the piston backward, which, in turn, pulls the actuating fluid back into the cylinder 530. This pulls the process fluid displacement member (diaphragm), causing the pumping chamber to increase in volume and to pull on the process fluid. New process fluid is drawn from the reservoir 524, or, if there is no reservoir, from filter 510, to replenish the dispensed amount. All valves close and unit is back at rest. Either a sensor detects a low fluid level in the reservoir (or in the filter if there is no reservoir), or the first stage automatically refills the reservoir (or filter) after every dispense. In either case, first stage pumping chamber 506 is already full of process fluid. Actuating fluid valve 532 is opened and the motor 526 is actuated to cause actuating fluid to be pushed into pumping chamber 506. This forces the process fluid through filter 510 and into reservoir 524, if present. Fluid can be pushed through the filter at any desired flow rate. Once the reservoir 524, or if there is no separate reservoir, the filter, is full, the motor reverses, fill valve 513 opens, and fresh process fluid is drawn into the pumping chamber 506 as the volume of the pumping chamber increases due to actuating fluid being pulled from it. The unit is now recharged and ready for the next dispense.

If desired, the process fluid can be recirculated, filtered and returned to the source bottle. To do this, valve 523 is opened so the process fluid can be pumped back to the source through line 521. The recirculation process keeps the fluid from becoming stagnant.

Figure 14:
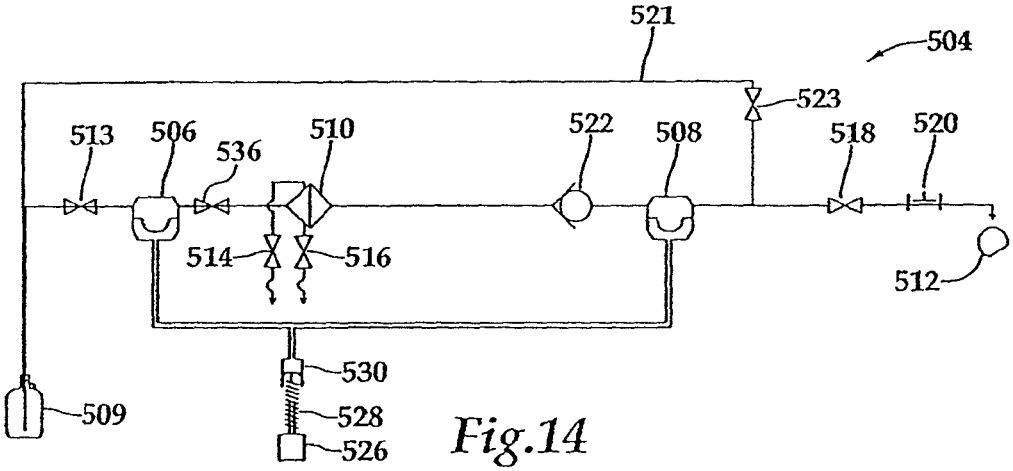
FIG. 14 is a schematic diagram of another alternate embodiment of a two-stage pumping system utilizing a multi-head pump in accordance with a fourth preferred embodiment of the present invention.

The two-stage pumping system of FIG. 14 functions similarly to the system shown in FIGS. 12 and 13. However, valve 532 is replaced by valve 536, and, instead of valves 532 being closed during dispensing, valve 536 is closed during dispensing and recharging of pumping chamber 508. Since the pumping chamber 506 is full of process fluid and both valves 513 and 536 are closed, actuating fluid is effectively blocked from flowing into or out of the pumping chamber 506, forcing it to flow only between pumping chamber 508 and cylinder 530. During actuation of the first stage pumping chamber 506, actuating fluid is forced to flow to the first stage pumping chamber, and away from the second stage pumping chamber 508, by having the second stage pumping chamber fully charged and closing dispense valve 518.

Each of the two, two-stage pumping systems 505 in FIG. 15 works in a manner substantially similar to those of the preceding examples. However, each of the actuation mechanisms (stepper motor 526, 526A, screw 528, 528A, piston within cylinder 530, 530A) drives only one of the two stages and therefore, they must be operated in a coordinated fashion. Once the actuation mechanism is coupled to the first stages of the two pumping systems, which are respectively represented by pumping chambers 506, and selectively actuates either one of the two first stages in a manner like that described above in connection with FIGS. 12-13. Similarly, the second actuation mechanism selectively actuates either of the pumping chambers 508 in the manner described. This arrangement, thus, confers the benefits of having fewer actuation mechanisms than pumping chambers, yet enables the two stages to be operated independently. Stages of more than two pumps can be driven by the same actuation mechanism, if desired.

Valves 532 and 534 are optional for each of the actuation mechanisms, although they can provide greater control and accuracy. Furthermore, no valve 536 on the outlet of the first stage pump is required when valves 532 and 534 are omitted, since the first stage of each of the two pumping systems is operated independently of the second stage of each of the two pumping systems. However, if the reservoirs or filters of the respective two-stage pumping systems 505 need to be filled independently, then an output valve, like valve 536, would be desirable to have.

The present invention can be configured for either internal or external suck back. For purposes of the present invention, "internal suck back" refers to draw back of fluid into the dispense tip after the completion of a dispense cycle. This is accomplished internal to the pump by reversing the actuation mechanism (e.g., stepper motor 526, screw 528, piston within cylinder 530). The term "external suck back" uses an external valve and control, typically placed as close to the dispense tip as possible. Both methods provide advantages and disadvantages, as described below.

Figure 16:
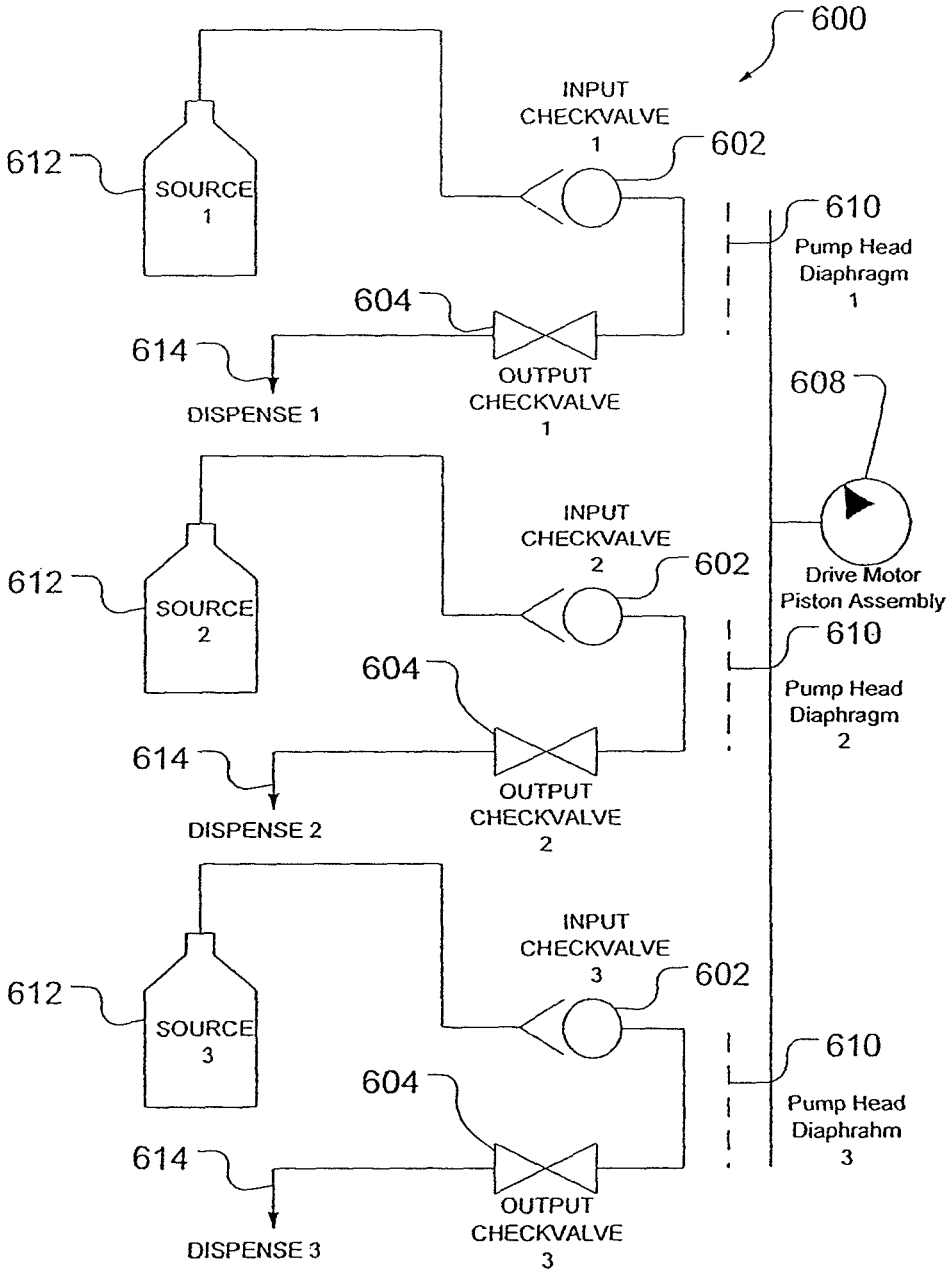
FIG. 16 is a schematic view of a single stage, multiple head pump, shown having internal suck back utilizing an input check-valve and an output valve.
Figure 17:
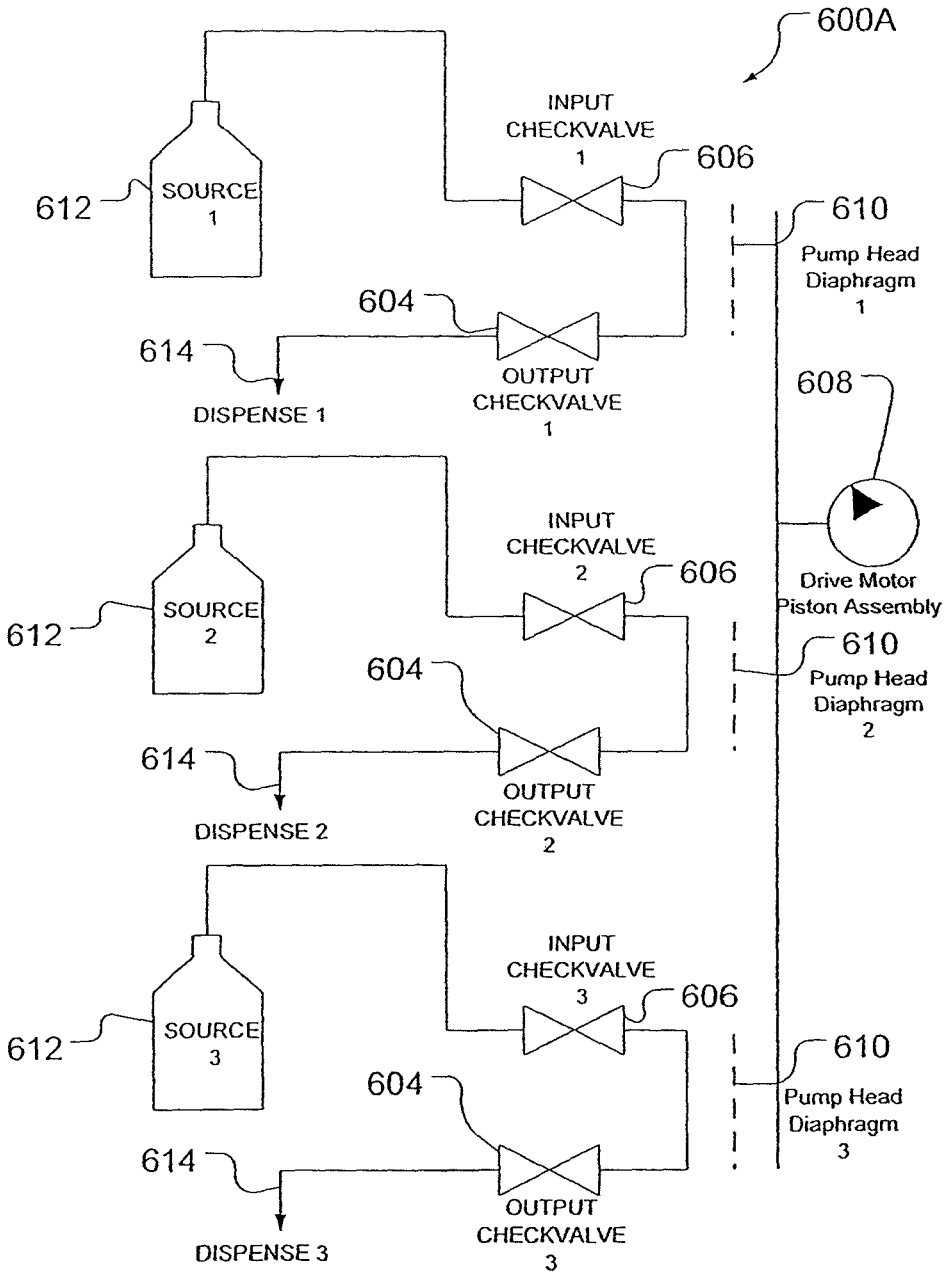
FIG. 17 is a schematic view of a single stage, multiple head pump, shown having internal suck back utilizing an input valve and an output valve.

Referring now to FIGS. 16 and 17, a pump having internal suck back 600 will now be described. In the internal suck back pump shown schematically in FIG. 16, an input check valve 602 and an output valve 604 are shown. The internal suck back pump 600A of FIG. 17 shows a system having an input valve 606 (rather than the check valve 602 of FIG. 16) and output valve 604. The pumps of FIGS. 16 and 17 operate with about the same effectiveness.

It is noted that, while the pumps shown in the various figures herein throughout this specification depict either all internal suck back pumps or all external suck back pumps, a mix of internal and external suck back pumps would operate effectively.

As shown in FIGS. 16 and 17, actuation mechanisms 608 are shown. The actuation mechanisms 608 may be similar to that previously described with respect to the prior embodiments and may include, for example, stepper motor, screw and piston within cylinder. The details will not be repeated here. The stepper motor of the actuation mechanism 608 drives the drive screw. The drive screw moves piston that is caused to reciprocate by the threads on the drive screw. As the drive screw is turned, the threads of the drive screw retract the piston, forcing the piston to be pulled slightly within its cylinder, thereby moving a diaphragm 610. The expanding volume in the pumping chamber draws fluid into the pumping chamber from the source 612. The fluid passes through the input check valve 602 (FIG. 16) or, optionally, the two-way valve 606 (FIG. 17) and into the pumping chamber. When the pumping chamber is full of fluid, all valves close and the unit comes to rest in its "ready" state.

When a dispense is called for, the selected output valve 604 is opened, and the stepper motor of the actuation mechanism 608 turns in the opposite direction, causing the piston to be driven in a displacement direction, reducing the volume of process fluid in the pumping chamber. This forces fluid out of the pumping chamber and through the output valve, then out of the dispense tip 614. The timing of the opening of the output valve 604 is controlled to give the desired process results. The output valve 604 can be opened slightly before the stepper motor of the actuation mechanism 608 starts to start dispensing, or it can be delayed to open at a desired point after the stepper motor starts operating. This allows the pump to build up pressure for different dispense characteristics.

Once the desired required volume of fluid is dispensed, and if internal suck back is required, the pump waits a desired delay time, if selected, then the stepper motor direction is reversed. The output valve 604 remains opened and the input valve 606 is kept closed (or, if a check valve 602 is used, as shown in FIG. 16, the suck back is done in such a way to keep the draw pressure below the cracking pressure of the check valve 602). As the stepper motor is stepped in the recharge direction, the fluid is drawn back up the dispense tip 614 to a desired point, or drawn back to a given volume in the cylinder or pumping chamber. Pulling the fluid back helps prevent the fluid from dripping and drying, causing contamination on the newly processed wafer below the dispense tip 614.

It is noted that if a pump the type shown in FIG. 5 is used, umbrella-shaped valve 256 must be removed or replaced with a two-way valve for proper operation if internal suck back is used.

Figure 18:
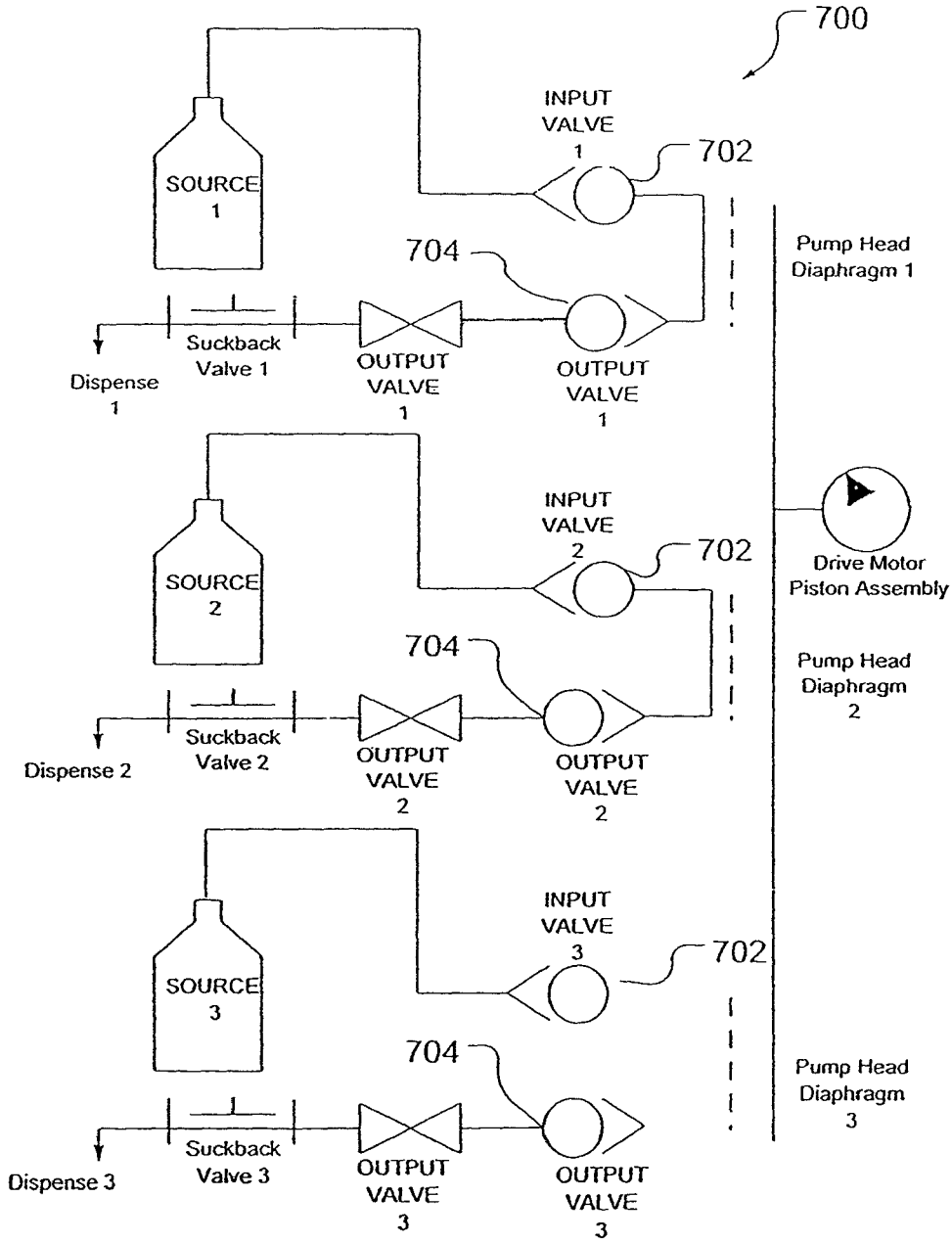
FIG. 18 is a schematic view of a single stage, multiple head pump, shown having external suck back utilizing input and output check-valves.
Figure 19:
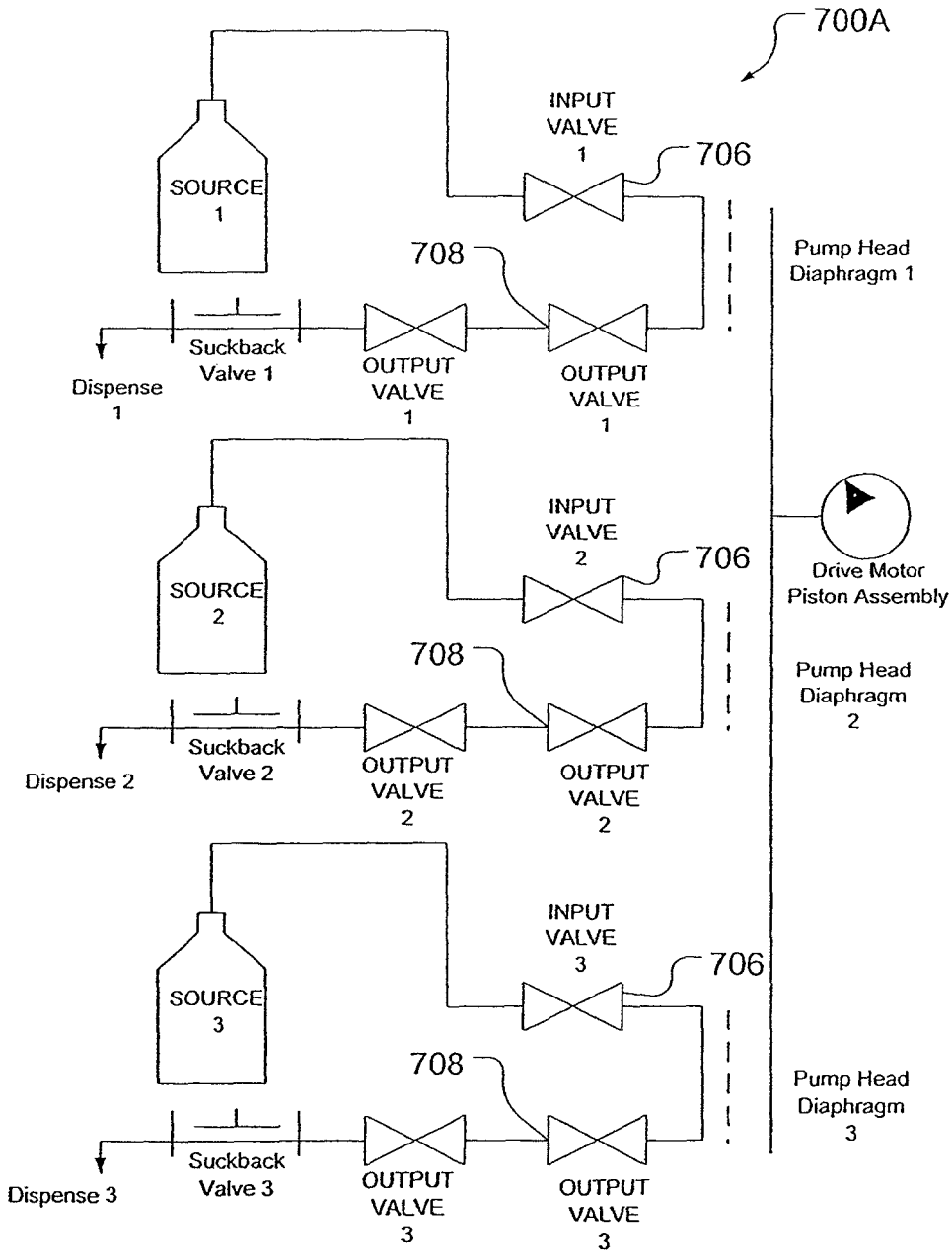
FIG. 19 is a schematic view of a single stage, multiple head pump, shown having external suck back utilizing input and output valves.

Next, a pump 700, 700A (see FIGS. 18 and 19) having external suck back will be described. External suck back is sometimes also called "remote suck back" and is used interchangeably. External suck back can be accomplished with check valves 702, 704, as shown in the pump 700 of FIG. 18 or as shown in the pump 700A of FIG. 19 with two valves, input valve 706 and output valve 708. As seen in FIGS. 18 and 19, suck back and its control is accomplished external to the single stage pump (e.g., as shown in FIGS. 2-10 as reference number 200). However, the same result is achieved as with internal suck back, as described with respect to FIGS. 16 and 17. A motor or other mechanism (such as an air actuator) moves a suck back piston in a remote housing.

Figure 18A:
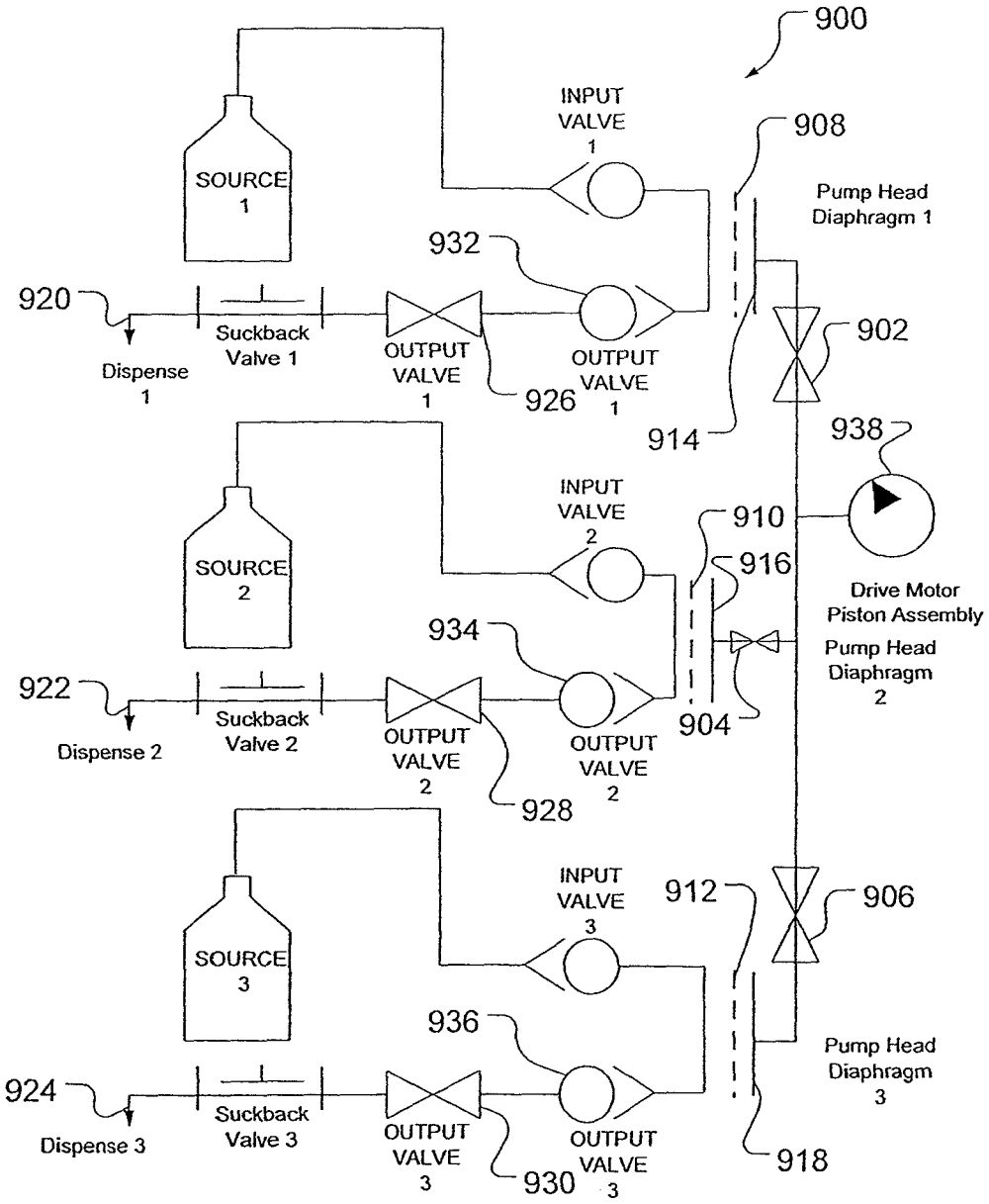
FIG. 18A is a schematic view of a single stage, multiple head pump, shown having external suck back utilizing input and output check-valves and a set of isolation valves.

FIG. 18A is similar to the pumps 700, 700A of FIGS. 18 and 19. FIG. 18A depicts a pump 900 having external suck back using similar check valves, input valves, output valves, and the like. However, the pump 900 includes the addition of three isolation valves 902, 904, 906. The three isolation valves 902, 904, 906 allow the diaphragms 908, 910, 912 and pump heads 914, 916, 918 to never see the pressure used by one another. For example, if all three isolation valves 902, 904, 905 are open and a dispense is made using pump head 914 at dispense tip 920 at 10 PSI. Output valve 926 is open, while output valves 928 and 930 are closed. No dispense is intended to be made using pump heads 916, 918 through dispense tips 922, 924. This 10 PSI pressure would be transmitted to the other two unused pump heads 916, 918 down to the closed output valves 928, 930 as well. The pressure in the whole system would go to 10 PSI. This includes the areas of the tubing between the unused output check valves 934, 936 and the output valves 928, 930. Of course, process fluid flows through the output check valve 932 currently in use. When the dispense through dispense tip 920 is complete, the 10 PSI pressure at the unused output check valves 934, 936 through to the output valves 928, 930 is maintained. Now, the example continues with a desired 3 PSI dispense from dispense point 922. Since there is a residual pressure of 10 PSI, as explained above, when output valve 928 is opened, a small blast of fluid at 10 PSI will first be made, then the pressure will drop down to the required 3 PSI. The use of the isolation valves 902, 904, 906, operated at appropriate intervals by a controller, is used to prevent this "crosstalk" in the channels, if needed. Specifically, prior to driving drive mechanism 938, the unused isolation valves (in the present example, isolation valves 904, 906) are closed. Actuating fluid therefore does not act on the unused pump heads (in the present example, pump heads 916, 918). Therefore the undesirable pressure, described above, is effectively eliminated.

The use of isolation valves 902, 904, 906 may also be used to selectively isolate at least one pump 914, 916, 918 at a time for dispensing. It is possible to simultaneously dispense out of more than one pump chamber at the time, even at different rates.

This is shown in more detail in the embodiment of FIGS. 22-25. Appropriate isolation valves 1004 may be, for example, LEE company, part number LHDA1260245D. However, any other very small valves such as cartridge valves could be used with different mounting configurations and different tolerances to various chemicals that are used as actuating fluids in the pump. Any appropriate two-way valve could be used.

The isolation valves 1004 are mounted into a cartridge valve subassembly 1002. There is at least one isolation valve 1004 for each pumping head 204' so that at least one isolation valve 1004 can be open during the dispense to selectively direct actuation fluid.

If the dispense is being executed out of a single pump head 204', then the isolation valve 1004 that corresponds to that pump head 204' is opened to selectively allow actuating fluid to flow into the actuating fluid chamber of pump head 204', thus affecting the pumping action for the process fluid.

Figure 25:
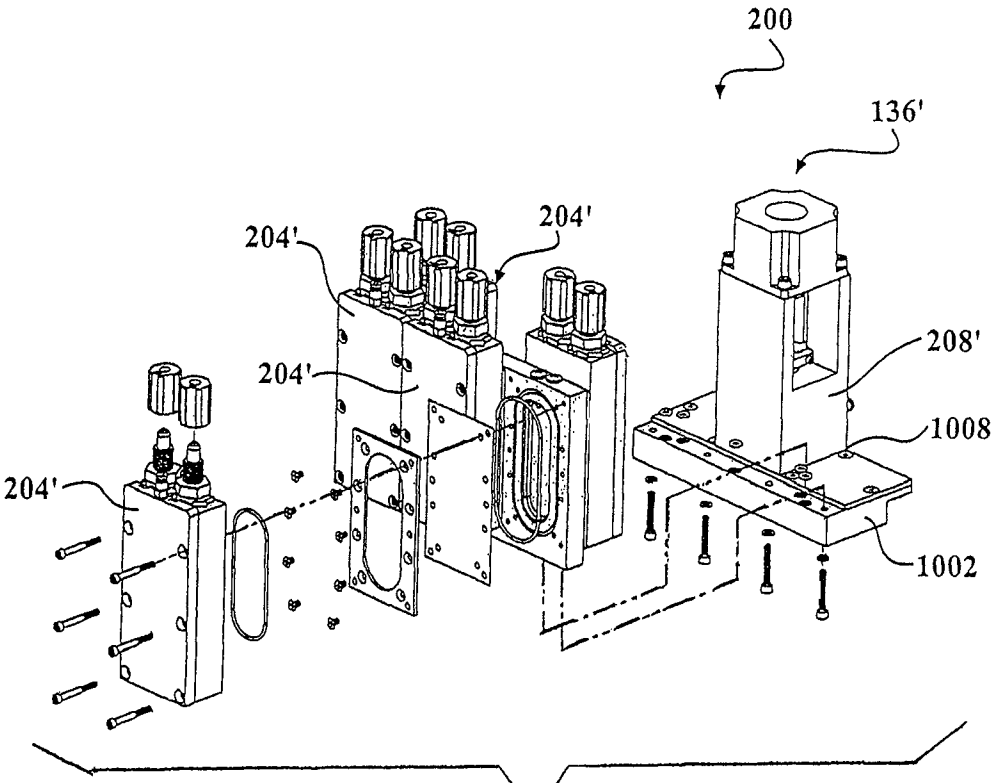
FIG. 25 is another partial exploded isometric view of the pump of FIG. 22.

It is possible to dispense out of more than one pumping head 204' at a time, even at different flow rates, while using the single actuating mechanism 136' (see FIG. 25). This is accomplished by using proportional control valves for the actuating fluid isolation valves, instead of the simple on/off valves 1004, such as cartridge valves. Preferably, the proportional control valves are installed in the same place as the standard on-off isolation valves, however, they would have proportional control functionality.

In pump's 200' control software, this is accomplished by setting the pump drive system flow rate equal to the sum of the individual flow rates required for each pump head involved in that particular pumping operation at that point of time in the dispense. Therefore, for each instance of time during the dispense, the total flow rate is equal to the sum of the individual flow rates required at each pump head. As a mathematical equation this would be represented with:

$$Q\text{ rate pump}\cdot\text{total}=Q\text{ rate }1+Q\text{ rate }2+\ldots+Q\text{ rate }n$$

In the pump control software, this value is constantly updated during the dispense and depends upon how the flow rates vary among the various dispense pumping heads involved in that particular dispense. The flow is divided by individually setting the proportional control for the isolation valves associated with the pump chambers. The setting for each isolation valve is determined according to the proportion of the flow that needs to be going out of the corresponding pump head at any given moment during the dispense. Therefore, for each instance of time during the dispense, the proportional control of the valves will be set according to the following mathematical equations:

$$\text{valve 1 setting}=Q\text{ rate }1/Q\text{ rate pump}\cdot\text{total}$$

$$\text{valve 2 setting}=Q\text{ rate }2/Q\text{ rate pump}\cdot\text{total}$$

$$\text{valve }n\text{ setting}=Q\text{ rate }n/Q\text{ rate pump}\cdot\text{total}$$

A typical software update/refresh rate for this type of control system application might be 250 ms. Therefore, every 250 ms the control software will check to see what the flow rate is supposed to be out of each of the pump chambers that is currently in use. The control software will then set the pump total flow rate and the valves proportional control settings accordingly (based on the above described equations).

It is important to note that this algorithm could be used in any pumping situation where a single drive system is used to pump out of multiple pump heads at the same time. It is not limited to the semiconductor industry, or any particular industry or application for that matter.

Figure 20:
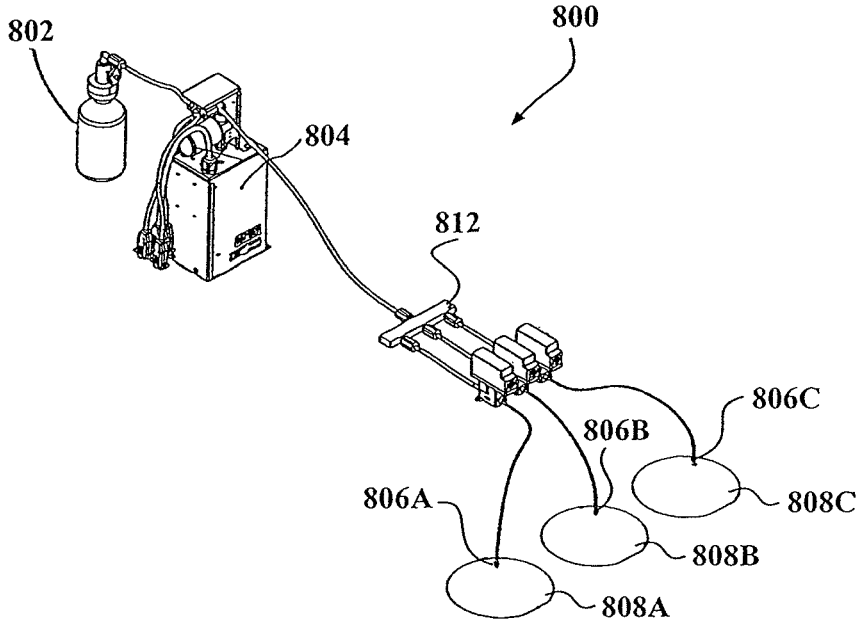
FIG. 20 is a simplified, isometric view of an alternate application of the pump of that splits its output to supply fluid to three separate outputs.
Figure 21:
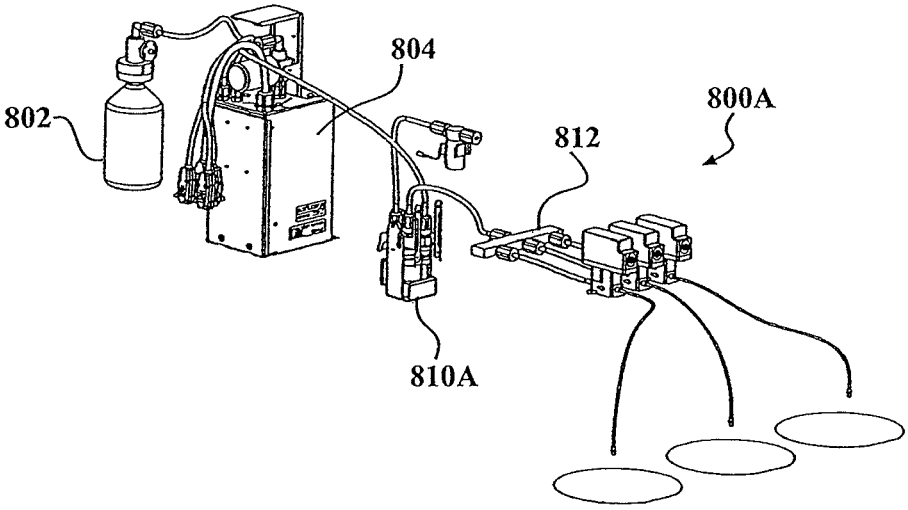
FIG. 21 is simplified, isometric view of the alternate embodiment of FIG. 20, shown with the addition of a filtering unit.
Figure 23:
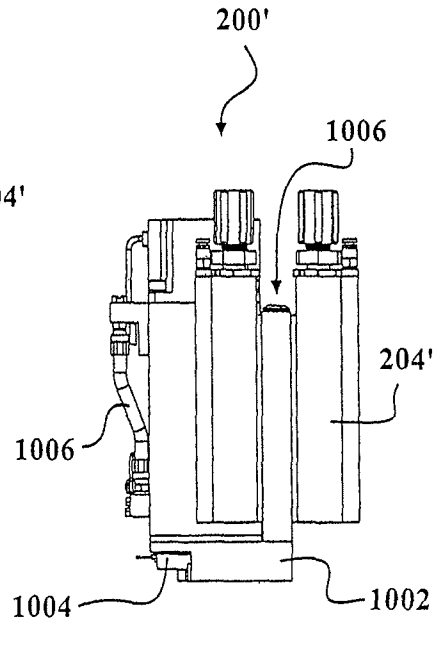
FIG. 23 is a side elevation view of the pump of FIG. 22.
Figure 22:
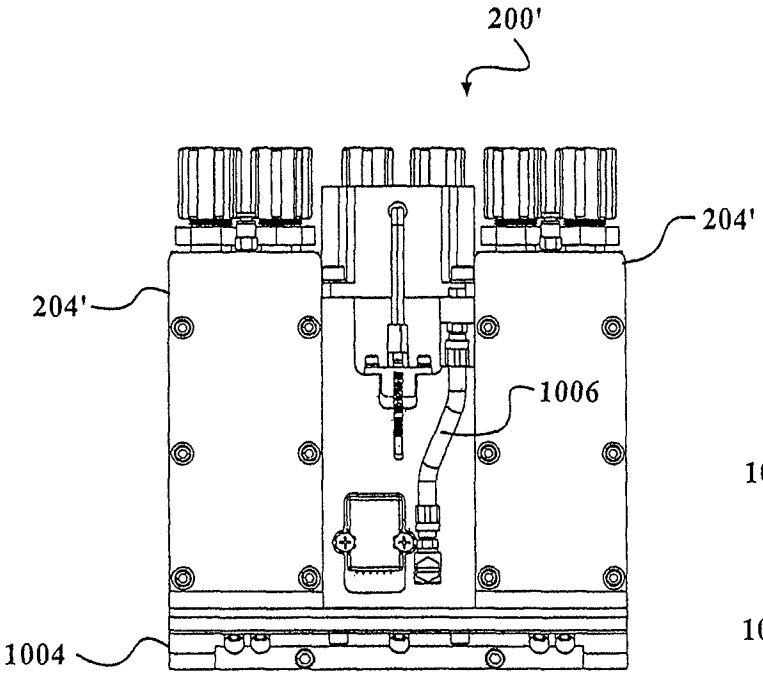
FIG. 22 is a rear elevation view of a pump having isolation valves in accordance with another alternate embodiment of a pump in accordance with the present invention.
Figure 24:
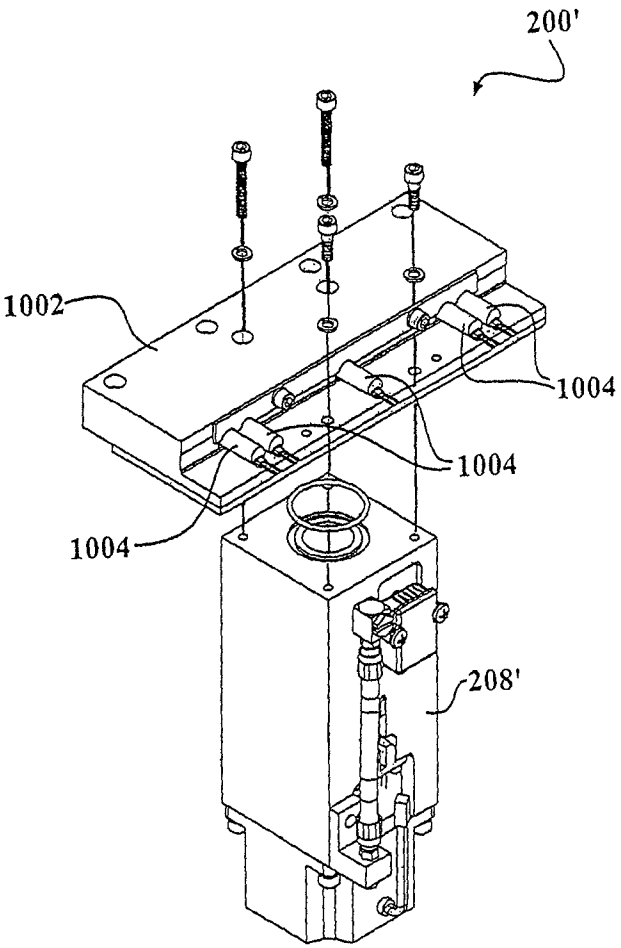
FIG. 24 is a partial exploded isometric view of the pump of FIG. 22.

Finally, the figures and description above refer to the different pumping head structures (e.g., 202, 204, 206, FIG. 7) each pumping a different chemistry onto a single wafer. This setup provides for use of a single pump to pick the desired chemistry. Another option, as shown in the pumps 800, 800A of FIGS. 20 and 21 is to use a single source 802 having a single chemistry and utilize a pump assembly 804 (for example, that shown in U.S. Pat. No. 4,950,124, the complete reference being fully incorporated by reference herein) having to supply the chemistry to different nozzles 806A, 806B, 806C for different wafers 808A, 808B, 808C. FIGS. 20 and 21 both show pumps 800, 800A and are essentially the same except that FIG. 21 adds filters 810A between the pump assembly 804 and manifold 812. The pumps assemblies 800, 800A shown in FIGS. 20 and 21 use a single source and single chemistry and split the output to multiple dispense points (nozzles 806A, 806B, 806C). It is noted that the pump assemblies here do not require multiple pumping head structures, as in the previous embodiments.

An advantage of this configuration is in the filtering. The filters are relatively expensive and must be changed regularly. However, in spite of the cost of the filters, the price of a defect in production is typically much more. Filters are therefore changed at a time prior to a time when they cause problems due to filter loading. Here, the filter is changed at one time for all dispense points associated with the pump.

Finally, splitting the output as shown in FIGS. 20 and 21 is not necessarily limited to the type of pump shown. The output of any pump may be split in this manner, including that of two stage pumps.

As stated above, one highly desirable feature of a precision pump in accordance with the present invention is the ability to separate and remove components of the pump 200' for maintenance or repair without breaking into the process fluid flow lines that are attached to one or more pump chamber heads. This would include avoiding opening of any seals in the process fluid flowpath either into, through, or out of the pump.

Figure 27:
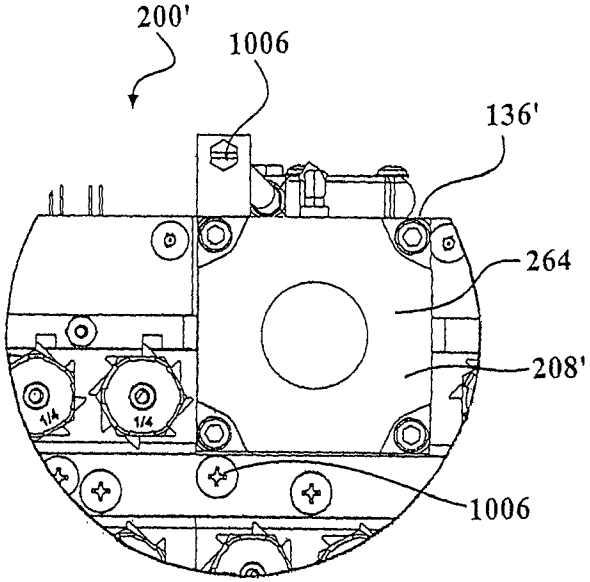
FIG. 27 is partial view of the pump of FIG. 26 depicting detail A.
Figure 26:
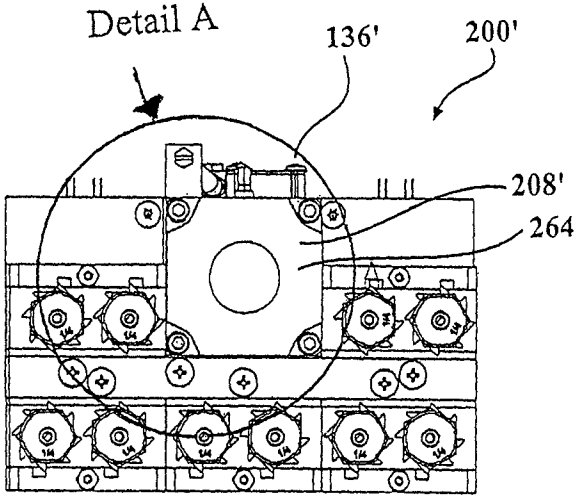
FIG. 26 is partial top view of the pump of FIG. 22.

As can best be seen in FIGS. 25-27, the pump 200' is designed such that the actuation mechanism 136' (including motor 264, drive screw (see FIG. 5 reference number 266), displacement element (see FIG. 5, reference number 209), cavity (see FIG. 5, reference number 207) and related components described above with respect to FIG. 5) is easy to separate from the central body 208'. The screws to attach the actuating mechanism 136' to the pump body 208' are easily accessible from the top of the pump 200'. Since the actuating mechanism 136' is the part of the pump that is most likely to need regular maintenance or repair, it is very useful to be able to remove the actuating mechanism 136' from the pump 200' without breaking into process lines that are attached into and out of each of the pumping chambers (214, as shown in FIG. 5) of the pumping head structures 202', 204', 205', 206'.

The motor 264, drive screw 266 and displacement element 209 of the pump are the most likely components to experience mechanical wear and failure. Therefore, it is advantageous to make it as easy as possible to repair or replace these items without breaking into any process fluid flow lines attached to each of the individual pumping heads 204'. Drain and fill tubes (as are well known) are provided to make it easy to remove and refill the actuating fluid in the pump drive assembly. To remove the actuating mechanism 136' one only needs to follow a two-step process:

1. Drain the actuating fluid out of the pump 200' using drain and fill tubes that are built into the pump 200.

2. Remove the top accessible screws to detach the drive system from the main body of the pump 200'.

This process will be described in further detail below.

A quick disconnect connection 1008, is be used between the central body 208' and a cartridge valve subassembly 1002 (See FIG. 25). While the details of such a quick disconnection 1008 are not specifically shown in the drawings, such quick disconnections are well known for connecting and disconnecting two machined parts (while proper alignment and connection between its various flowpaths are maintained).

Also, a quick disconnect connection 1008 between the central body 208' and the cartridge valve subassembly 1002 may be made using a tube that could is split to direct actuation fluid to another pump head assembly 204' with, for example, five separate pump heads on it. The effect of this would be that the actuating mechanism 136' could be used to pump through numerous (for example, five or more) pump heads.

Alternatively, as can be seen in FIG. 25, each of the pumping heads 204' may be removed from the pumping head mounting plate 1010 while maintaining the integrity of the seals directed to the process fluid. Again, this provides for easy maintainability of the pump 200'

Another possible means to make maintaining the pump easier is to use either a process fluid chamber or an actuating fluid chamber of one or more of the pumping heads to store process fluid during a maintenance operation or a process operation and to store actuating fluid during a maintenance operation or a process operation. This can be accomplished utilizing software to transfer all such fluids to one or more of these chambers in order to maintain a different pumping head on the pump.

Finally, a three way valve can be used to easily switch flow from one pumping head to another to provide redundancy in the event of a problem with one of the pumping heads.

The foregoing description is of an exemplary and preferred embodiment of multiple dispense head pumps employing at least in part certain teachings of the invention. The invention, as defined by the appended claims, is not limited to the described embodiments. Alterations and modifications to the disclosed embodiments may be made without departing from the invention. The terms used in this specification are, unless expressly stated otherwise, intended to have ordinary and customary meaning and are not intended to be limited to the details of the illustrated structures or the disclosed embodiments. None of the descriptions in the present application should be read as implying that any particular element, step, or function is an essential element which must be included in the claim scope. The scope of patented subject matter is defined only by the allowed claims. Moreover, none of these claims is intended to invoke paragraph six of 35 U.S.C. §112 unless the exact words "means for" or "steps for" are followed by a participle.

What is claimed is:

1. A pump for use in handling one or more different process fluids, comprising:

a plurality of pumping chambers, each pumping chamber adapted to independently pump one of the plurality of different process fluids, each pumping chamber including a process fluid inlet and a process fluid outlet, and a process fluid valve associated with each pumping chamber, the process fluid outlet coupled to the process fluid valve for selectively preventing and allowing the flow of process fluid through the pumping chamber;

an actuation mechanism for selectively pumping substantially incompressible actuating fluid to and from a plurality of actuating fluid chambers, wherein the actuation mechanism is in fluid communication with the plurality of actuating fluid chambers, the actuation mechanism selectively actuatable in a first direction to force actuating fluid into one of the plurality of actuating fluid chambers when dispensing one of the plurality of different process fluids and selectively actuatable in a second direction to draw actuating fluid out of one of the plurality of actuating fluid chambers thereby drawing one of the plurality of different process fluids into one of the plurality of pumping chambers, wherein the actuating fluid is in a closed system such that substantially no actuating fluid is removed from the system;

at least one diaphragm separating each pumping chamber from an associated actuating fluid chamber, for separating process fluid from actuating fluid;

wherein the actuation mechanism is removable by a quick disconnect connection that provides for disconnection of the activation mechanism without affecting process fluid in the process fluid inlet, process fluid outlet, process fluid valve, or process fluid in each pumping chamber; and whereby operation of the actuation mechanism to displace actuating fluid causes actuating fluid to flow only into each of the plurality of actuating fluid chambers having an opened process fluid valve, resulting in pumping of process fluid.

2. The pump of claim 1, wherein the actuation mechanism is mounted within a body, and each of the plurality of pumping chambers is at least partially formed by a removable pump head structure supported on the body.

3. The pump of claim 1, further comprising a plurality of pump head structures, the plurality of pump head structures being arrayed around the body.

4. The pump of claim 1, including a plurality of isolation valves, each isolation valve located between the actuating mechanism and one of the plurality of actuating fluid chambers for selectively preventing and allowing the flow of actuating fluid between the actuating mechanism and one or more selected actuating fluid chambers.

5. The pump of claim 4, wherein each isolation valve is a proportional control valve to enable dispensing out of more than one pumping head simultaneously, at least one flow rate using only one actuating mechanism.

6. A pump for use in handling one or more different process fluids, comprising:

a plurality of pumping chambers and a like plurality of actuating fluid chambers, forming a plurality of pairs of pumping chambers and actuating fluid chambers, each pair having one of the pumping chambers adjacent one of said actuating fluid chambers, each pumping chamber including at least one process fluid inlet and at least one process fluid outlet and at least one process fluid outlet on each pumping chamber coupled to at least one process fluid valve associated with each pumping chamber for selectively preventing and allowing the flow of process fluid through the pumping chamber;

an actuation mechanism for pumping substantially incompressible actuating fluid to and from a plurality of actuating fluid chambers, wherein the actuation mechanism is in fluid communication with the plurality of actuating fluid chambers, the actuation mechanism selectively actuatable in a first direction to force actuating fluid into one of the plurality of actuating fluid chambers when dispensing one of the plurality of different process fluids and selectively actuatable in a second direction to draw actuating fluid out of one of the plurality of actuating fluid chambers thereby drawing one of the plurality of different process fluids into one of the plurality of pumping chambers, wherein the actuating fluid is in a closed system such that substantially no actuating fluid is removed from the system, wherein the actuation mechanism is removable by a quick disconnect connection that provides for disconnection of the activation mechanism without affecting process fluid in the process fluid inlet, process fluid outlet, process fluid valve, or process fluid in each pumping chamber;

a diaphragm associated with each pair, located between the pumping chamber and actuating fluid chamber, for separating process fluid from actuating fluid, each actuating fluid chamber in fluid communication with the actuation mechanism permitting flow into the actuating fluid chamber of actuating fluid;

whereby operation of the actuation mechanism to displace actuating fluid causes actuating fluid to flow only into each of the plurality of actuating fluid chambers having an opened process fluid valve, resulting in pumping.

7. The pump of claim 6, wherein unrestricted flow of actuating fluid from any actuating fluid chamber into the actuation mechanism is provided.

8. The pump of claim 6, wherein the actuation mechanism is mounted within a body, and each of the plurality of pumping chambers is at least partially formed by a removable pump head structure supported on the body.

9. The pump of claim 6, further comprising a plurality of pump head structures, the plurality of pump head structures being arrayed around the body.

10. The pump of claim 6, comprised of a plurality of actuation mechanisms, wherein a number of the plurality of pumping chambers exceeds a number of the actuation mechanisms.

11. The pump of claim 6, including a plurality of isolation valves, each isolation valve located between the actuating mechanism and one of the plurality of actuating fluid chambers for selectively preventing and allowing the flow of actuating fluid between the actuating mechanism and one or more selected actuating fluid chambers.

12. The pump of claim 11, wherein each isolation valve is a proportional control valve to enable dispensing out of more than one pumping head simultaneously, at least one flow rate using only one of the actuating mechanism.

13. A pump for use in handling one or more different process fluids, comprising:

an actuation mechanism for pumping actuating fluid, wherein the actuation mechanism is removable by a quick disconnect connection that provides for disconnection of the activation mechanism without affecting process fluid in the process fluid inlet, process fluid outlet, process fluid valve, or process fluid in each pumping chamber;

a plurality of pumping chambers and a like plurality of actuating fluid chambers, forming a plurality of pairs, each pair having one of said pumping chambers adjacent one of said actuating fluid chambers, each pumping chamber including at least one process fluid inlet and at least one process fluid outlet;

a diaphragm associated with each pair, located between the pumping chamber and actuating fluid chamber, for separating process fluid from actuating fluid;

each actuating fluid chamber in fluid communication with the actuation mechanism to provide for flow into each actuating fluid chamber of substantially incompressible actuating fluid;

the process fluid inlet on a first one of the pumping chambers in communication with a source of process fluid, the process fluid outlet on the first one of the pumping chambers in communication with the process fluid inlet on a second one of the pumping chambers, the process fluid outlet on the second one of the pumping chambers in fluid communication with a dispense point;

each pumping chamber coupled to at least one process fluid valve on each pumping chamber for selectively preventing and allowing the flow of process fluid through the pumping chamber;

whereby operation of the actuation mechanism to displace actuating fluid causes actuating fluid to flow only into each of the plurality of actuating fluid chambers having an opened process fluid valve, resulting in pumping.

14. The pump of claim 13, including a valve between the actuating mechanism and the actuating fluid chamber in the first one of the pumping chambers and a valve between the actuating mechanism and an inlet of the actuating fluid chamber in the second one of pumping chambers.

15. The pump of claim 13, including a fluid treatment unit for treating process fluid.

16. The pump of claim 13, further comprising a one-way check valve coupled with the process fluid outlet of each of the plurality of pumping chambers for allowing fluid to flow only in one direction out of the pumping chamber, and a one-way check valve coupled with the process fluid inlet of each of the plurality of pumping chambers for allowing fluid to flow only in one direction into the pumping chamber.

17. The pump of claim 13, wherein the actuation mechanism is mounted within a body, and each of the plurality of pumping chambers is at least partially formed on the body.

18. The pump of claim 13, further comprising a plurality of pump head structures, the plurality of pump head structures being arrayed around the body.

19. The pump of claim 13, further comprising a plurality of pump head structures, the pump head structures being remote from the body.

20. The pump of claim 13 comprised of a plurality of actuation mechanisms, wherein a number of the plurality of pumping chambers exceeds a number of the actuation mechanisms and wherein each of the actuation mechanisms is removable by a quick disconnect connection that provides for disconnection of the actuation mechanism.

21. The pump of claim 13, including a plurality of isolation valves, each isolation valve located between the actuating mechanism and one of the plurality of actuating fluid chambers for selectively preventing and allowing the flow of actuating fluid between the actuating mechanism and one or more selected actuating fluid chambers.

22. The pump of claim 21, wherein each isolation valve is a proportional control valve to enable dispensing out of more than one pumping head simultaneously, at least one flow rate using a single one of the actuating mechanism.

23. A pump for use in handling one or more different process fluids, comprising:

a plurality of pumping chambers, each pumping chamber adapted to independently pump one of the plurality of different process fluids, each pumping chamber including a process fluid inlet and a process fluid outlet, and a process fluid valve associated with each pumping chamber, the process fluid outlet coupled to the process fluid valve for selectively preventing and allowing the flow of process fluid through the pumping chamber;

an actuation mechanism for selectively pumping substantially incompressible actuating fluid to and from a plurality of actuating fluid chambers, wherein the actuation mechanism is in fluid communication with the plurality of actuating fluid chambers, the actuating mechanism selectively actuatable in a first direction to force actuating fluid into one of the plurality of actuating fluid chambers when dispensing one of the plurality of different process fluids and selectively actuatable in a second direction to draw actuating fluid out of one of the plurality of actuating fluid chambers thereby drawing one of the plurality of different process fluids into one of the plurality of pumping chambers, wherein the actuating fluid is in a closed system such that substantially no actuating fluid is removed from the system;

at least one diaphragm separating each pumping chamber from an associated actuating fluid chamber, for separating process fluid from actuating fluid;

a plurality of isolation valves, each isolation valve for selectively preventing and allowing the flow of activation fluid;

whereby operation of the actuation mechanism to displace actuating fluid causes actuating fluid to flow into each of the plurality of actuating fluid chambers having an opened process fluid valve, resulting in pumping of process fluids;

wherein the actuation mechanism is mounted within a body, and each of the plurality of pumping chambers is at least partially formed by a removable pump head structure supported on the body.

24. The pump of claim 23, further comprising a plurality of pump head structures, the plurality of pump head structures being arrayed around the body.

25. The pump of claim 23, wherein each isolation valve is a proportional control valve to enable dispensing out of more than one pumping head simultaneously, at least one flow rate using only one actuating mechanism.

* * * * *